US008605013B2

(12) United States Patent
Hashimoto et al.

(10) Patent No.: US 8,605,013 B2
(45) Date of Patent: Dec. 10, 2013

(54) PLASMA DISPLAY DEVICE, AND PLASMA DISPLAY PANEL DRIVING METHOD

(75) Inventors: Shinichiro Hashimoto, Osaka (JP); Kenji Ogawa, Osaka (JP); Shunsuke Kawai, Osaka (JP)

(73) Assignee: Panasonic Corporation, Osaka (JP)

( * ) Notice: Subject to any disclaimer, the term of this patent is extended or adjusted under 35 U.S.C. 154(b) by 530 days.

(21) Appl. No.: 12/513,437

(22) PCT Filed: Jun. 12, 2008

(86) PCT No.: PCT/JP2008/001499

§ 371 (c)(1),
(2), (4) Date: May 4, 2009

(87) PCT Pub. No.: WO2008/152808

PCT Pub. Date: Dec. 18, 2008

(65) Prior Publication Data

US 2010/0060625 A1 Mar. 11, 2010

(30) Foreign Application Priority Data

Jun. 13, 2007 (JP) ..... 2007-156021

(51) Int. Cl.
*G09G 3/28* (2013.01)

(52) U.S. Cl.
USPC ..... 345/60; 345/30; 345/55; 345/211

(58) Field of Classification Search
USPC ..... 345/30, 37, 41, 60–68, 211–215, 204
See application file for complete search history.

(56) References Cited

U.S. PATENT DOCUMENTS

| | | | |
|---|---|---|---|
| 6,603,447 | B1 | 8/2003 | Ito |
| 6,738,033 | B1 | 5/2004 | Hibino |
| 6,791,516 | B2 | 9/2004 | Kang |
| 6,900,598 | B2 | 5/2005 | Hibino |

(Continued)

FOREIGN PATENT DOCUMENTS

| | | | |
|---|---|---|---|
| JP | 2000-242224 | A | 9/2000 |
| JP | 2000267625 | A | 9/2000 |

(Continued)

OTHER PUBLICATIONS

International Search Report for International Application No. PCT/JP2008/001499, Sep. 16, 2008, Panasonic Corporation.

(Continued)

*Primary Examiner* — Christopher E Leiby
(74) *Attorney, Agent, or Firm* — RatnerPrestia

(57) ABSTRACT

Provided to stabilize generation of address discharge and improve gradation characteristics of display images are the following elements: a plasma display panel; a sustain pulse generating circuit; and a ramp voltage generating circuit including a first ramp voltage generating circuit, a second ramp voltage generating circuit, and a switching circuit. The first ramp voltage generating circuit generates a first ramp voltage gently increasing in an initializing period. The second ramp voltage generating circuit generates a second ramp voltage increasing with a gradient gentler than that of the rising edge of a sustain pulse and steeper than that of the first ramp voltage, at the end of each sustain period. The switching circuit stops the operation of the second ramp voltage generating circuit immediately after the second ramp voltage reaches a predetermined electric potential. In at least one sustain period of one field, no sustain pulse but the second ramp voltage is generated.

3 Claims, 9 Drawing Sheets

(56) References Cited

U.S. PATENT DOCUMENTS

| | | | | |
|---|---|---|---|---|
| 7,911,417 | B2 | 3/2011 | Kang | |
| 2002/0130825 | A1 | 9/2002 | Kang | |
| 2004/0080280 | A1 | 4/2004 | Hibino | |
| 2004/0257308 | A1 | 12/2004 | Yang | |
| 2005/0007314 | A1 | 1/2005 | Kang | |
| 2005/0030259 | A1* | 2/2005 | Kim et al. | 345/60 |
| 2005/0073485 | A1 | 4/2005 | Kim et al. | |
| 2005/0162350 | A1 | 7/2005 | Han | |
| 2005/0174304 | A1 | 8/2005 | Kim | |
| 2006/0007064 | A1 | 1/2006 | Choi et al. | |
| 2006/0050022 | A1 | 3/2006 | Kang | |
| 2006/0187147 | A1 | 8/2006 | Jeong | |
| 2006/0279479 | A1* | 12/2006 | Jung et al. | 345/60 |
| 2007/0069987 | A1 | 3/2007 | Park et al. | |
| 2007/0085766 | A1* | 4/2007 | Yoo | 345/63 |
| 2007/0097026 | A1 | 5/2007 | Moon | |
| 2011/0122112 | A1* | 5/2011 | Kawai et al. | 345/208 |

FOREIGN PATENT DOCUMENTS

| | | | |
|---|---|---|---|
| JP | 2000305510 | A | 11/2000 |
| JP | 2001-318649 | A | 11/2001 |
| JP | 2002304153 | A | 10/2002 |
| JP | 2003-005700 | A | 1/2003 |
| JP | 2003-114640 | A | 4/2003 |
| JP | 2003-263127 | A | 9/2003 |
| JP | 2004-348140 | A | 12/2004 |
| JP | 2005-010780 | A | 1/2005 |
| JP | 2005-141224 | A | 6/2005 |
| JP | 2005-222020 | A | 8/2005 |
| JP | 2005222020 | A | 8/2005 |
| JP | 2006-011459 | A | 1/2006 |
| JP | 2006-31040 | A | 2/2006 |
| JP | 2006184486 | A | 7/2006 |
| JP | 2006-235598 | A | 9/2006 |
| JP | 2007-108487 | A | 4/2007 |
| JP | 2007-122065 | A | 5/2007 |

OTHER PUBLICATIONS

Supplementary European Search Report for EP 08 76 4094, Oct. 25, 2010.

JP Office Action for 2008-550580, Oct. 30, 2012.

* cited by examiner

PLASMA DISPLAY DEVICE, AND PLASMA DISPLAY PANEL DRIVING METHOD

THIS APPLICATION IS A U.S. NATIONAL PHASE APPLICATION OF PCT INTERNATIONAL APPLICATION PCT/JP2008/001499.

TECHNICAL FIELD

The present invention relates to a plasma display device and a plasma display panel driving method for use in a wall-mounted television or a large monitor.

BACKGROUND ART

An alternating-current surface-discharge panel representative of a plasma display panel (hereinafter abbreviated as "panel") has a large number of discharge cells that are formed between the front plate and the rear plate faced to each other. For the front plate, a plurality of display electrode pairs, each made of a scan electrode and a sustain electrode, are formed on a front glass substrate in parallel with each other. A dielectric layer and a protective layer are formed to cover these display electrode pairs. For the rear plate, a plurality of parallel data electrodes are formed on a rear glass substrate and a dielectric layer is formed over the data electrodes to cover them. Further, a plurality of barrier ribs are formed on the dielectric layer in parallel with the data electrodes. Phosphor layers are formed over the surface of the dielectric layer and the side faces of the barrier ribs. The front plate and the rear plate are faced to each other and sealed together so that the display electrode pairs intersect with data electrodes. A discharge gas containing xenon in a partial pressure ratio of 5%, for example, is charged in the inside discharge space formed between the plates. Discharge cells are formed in portions where the display electrode pairs are faced to the data electrodes. For a panel formed as above, gas discharge generates ultraviolet light in each discharge cell. This ultraviolet light excites the red (R), green (G), and blue (G) phosphors so that the phosphors emit the corresponding colors for color display.

A general method for driving a panel is a subfield method: one field is divided into a plurality of subfields and combinations of light-emitting subfields provide gradation display. Each subfield has an initializing period, an address period, and a sustain period. In the initializing period, initializing discharge is caused to form wall charges necessary for the succeeding address operation on the respective electrodes and to generate priming particles (priming for discharge=excitation particles) for causing stable address discharge. In the address period, an address pulse voltage is applied selectively to the discharge cells to be lit so that address discharge is caused and wall charges are formed (hereinafter, this operation being also referred to as "addressing"). In the sustain period, a sustain pulse voltage is applied alternately to the scan electrode and the sustain electrode forming each display electrode pair, to cause sustain discharge in the discharge cells having generated address discharge and to cause light emission of the phosphor layers in the corresponding discharge cells. Thus, an image is displayed.

The driving method is described hereinafter in the subfield methods. Initializing discharge is caused by a gently changing voltage and the initializing discharge is selectively caused in the discharge cells which have executed sustain discharge. Thus, the light emission unrelated to gradation display is minimized and the contrast ratio is improved.

Specifically, in the initializing period of one subfield out of a plurality of subfields, an all-cell initializing operation for causing initializing discharge in all the discharge cells is performed. In the initializing periods of the other subfields, a selective initializing operation for causing initializing discharge only in the discharge cells having generated sustain discharge in the preceding sustain period is performed. In this driving method, the luminance of the area displaying a black picture (hereinafter, "black picture level") that changes depending on the light emission unrelated to image display is only due to the weak light emission caused by the all-cell initializing operation. Thus, an image having a high contrast can be displayed (see Patent Document 1, for example).

Further, above Patent Document 1 includes the descriptions of so-called erasing discharge using a narrow width pulse. In this erasing discharge, the width of the last sustain pulse in the sustain period is set shorter than the width of the other sustain pulses so that the electric potential difference between the electrodes of each display electrode pair caused by the wall charges thereon is alleviated. This erasing discharge using a narrow pulse can stabilize the address operation in the address period of the succeeding subfield. Thus, a plasma display device providing a high contrast ratio can be implemented.

Another technique is disclosed. For this technique, in each sustain period, after application of sustain pulses to the display electrode pairs are completed, an increasing ramp voltage is applied to the sustain electrodes to erase the wall charges in the discharge cells (see Patent Document 2, for example).

Still another technique is disclosed. For this technique, in each sustain period, after application of sustain pulses to the display electrode pairs are completed, a ramp voltage increasing to and kept at a predetermined value for a predetermined time period is applied to the scan electrodes, and thereafter an increasing ramp voltage is applied to the sustain electrodes. Thus, the wall charges in the discharge cells are erased (see Patent Document 3, for example).

Yet another technique is disclosed. For this technique, in each sustain period, after application of sustain pulses to the display electrode pairs are completed, an increasing ramp voltage is applied to the scan electrodes so that the gradient of the ramp voltage is changed according to the average luminance of a display image. Thus, the wall charges in the discharge cells are erased (see Patent Document 4, for example).

However, each of the techniques described in Patent Document 2 and Patent Document 3 requires a circuit for generating the ramp voltage to be applied to the sustain electrodes. The technique described in Patent Document 4 requires a circuit for changing the gradient of the ramp voltage. In each of these techniques, the size of the circuit is increased.

In recent years, with compliance of panels with higher definition, further miniaturization of discharge cells has been actively promoted. It is confirmed that so-called "charge decreasing", a phenomenon of wall charge loss, is likely to occur in the miniaturized discharge cells. The charge decreasing poses problems, such as occurrence of discharge failure resulting in deterioration of the image display quality, and an increase in the applied voltage necessary for causing discharge.

One of the major causes for occurrence of charge decreasing is a variation in the discharge in address operation. For example, if a large variation in the discharge in address operation causes strong address discharge, in some portions where a discharge cell to be lit is adjacent to a discharge cell to be unlit, the discharge cell to be lit deprives the discharge cell to be unlit of wall charges. This phenomenon causes charge decreasing.

For this reason, generating address discharge as stably as possible is important in preventing charge decreasing.

On the other hand, in recent years, further increases in the screen size and definition of a panel have actively been promoted. Accordingly, the drive impedance of the panel tends to increase. At high drive impedance, waveform distortion, such as ringing, is likely to occur in the drive waveform generated in the driving circuit of the panel. The above erasing discharge using a narrow width pulse is intended for stabilizing the address operation in the succeeding subfield. If a waveform distortion occurs in the drive waveform for generating this erasing discharge using a narrow pulse, the erasing discharge using a narrow width pulse can be generated strongly. In such a case, it is difficult to stabilize generation of the succeeding address discharge.

Further, with recent increases in the screen size, luminance, and definition of a panel, further improvement of the image display quality has been requested of the plasma display device.

[Patent Document 1] Japanese Patent Unexamined Publication No. 2000-242224

[Patent Document 2] Japanese Patent Unexamined Publication No. 2004-348140

[Patent Document 3] Japanese Patent Unexamined Publication No. 2005-141224

[Patent Document 4] Japanese Patent Unexamined Publication No. 2003-5700

SUMMARY OF THE INVENTION

A plasma display device includes the following elements: a panel; a sustain pulse generating circuit; and a ramp voltage generating circuit including a first ramp voltage generating circuit, a second ramp voltage generating circuit, and a switching circuit. The panel is driven by a subfield method for providing, in one field, a plurality of subfields, each including an initializing period, an address period, and a sustain period, to display gradation. The panel includes a plurality of discharge cells, each including a display electrode pair made of a scan electrode and a sustain electrode. The sustain pulse generating circuit generates a sustain pulse for causing discharge at a the number of times corresponding to a luminance weight in the display cells by causing resonance between interelectrode capacitance of the display electrode pairs and an inductor, and applies the sustain pulse alternately to the scan electrode and the sustain electrode of each display electrode pair in the sustain periods. The first ramp voltage generating circuit generates a first ramp voltage gently increasing in the initializing periods. The second ramp voltage generating circuit generates a second ramp voltage increasing with a gradient gentler than that of the rising edge of the sustain pulse and steeper than that of the first ramp voltage, at the end of each sustain period. The switching circuit stops the operation of the second ramp voltage generating circuit immediately after the second ramp voltage has reached a predetermined electric potential. In at least one of the sustain periods of the one field, the sustain pulse generating circuit generates no sustain pulse, and the ramp voltage generating circuit generates the second ramp voltage.

In this structure, the second ramp voltage, i.e. an increasing ramp voltage for erasing discharge to be applied to the scan electrodes at the end of each sustain period, is drops immediately after the increasing voltage has reached a voltage Vers, i.e. the predetermined electric potential. This structure can prevent occurrence of abnormal electric discharge in the discharge cells and adjust the wall voltages in the discharge cells appropriate for stabilizing the succeeding address operation even in a panel having a larger screen size and higher definition. Thus, this structure can stabilize generation of address discharge and reduce the operation failure in addressing without increasing the applied voltage necessary for the address discharge. Further, the erasing discharge can be generated at a discharge intensity weaker than that of the sustain discharge and greater than that of the initializing discharge in an all-cell initializing operation. Therefore, the gradation characteristics of a display image and thus the image display quality of the panel can be improved by providing, in the one field, at least one subfield having a sustain period in which no sustain pulse but only the second ramp voltage is generated.

REFERENCE MARKS IN THE DRAWINGS

Figure 1:
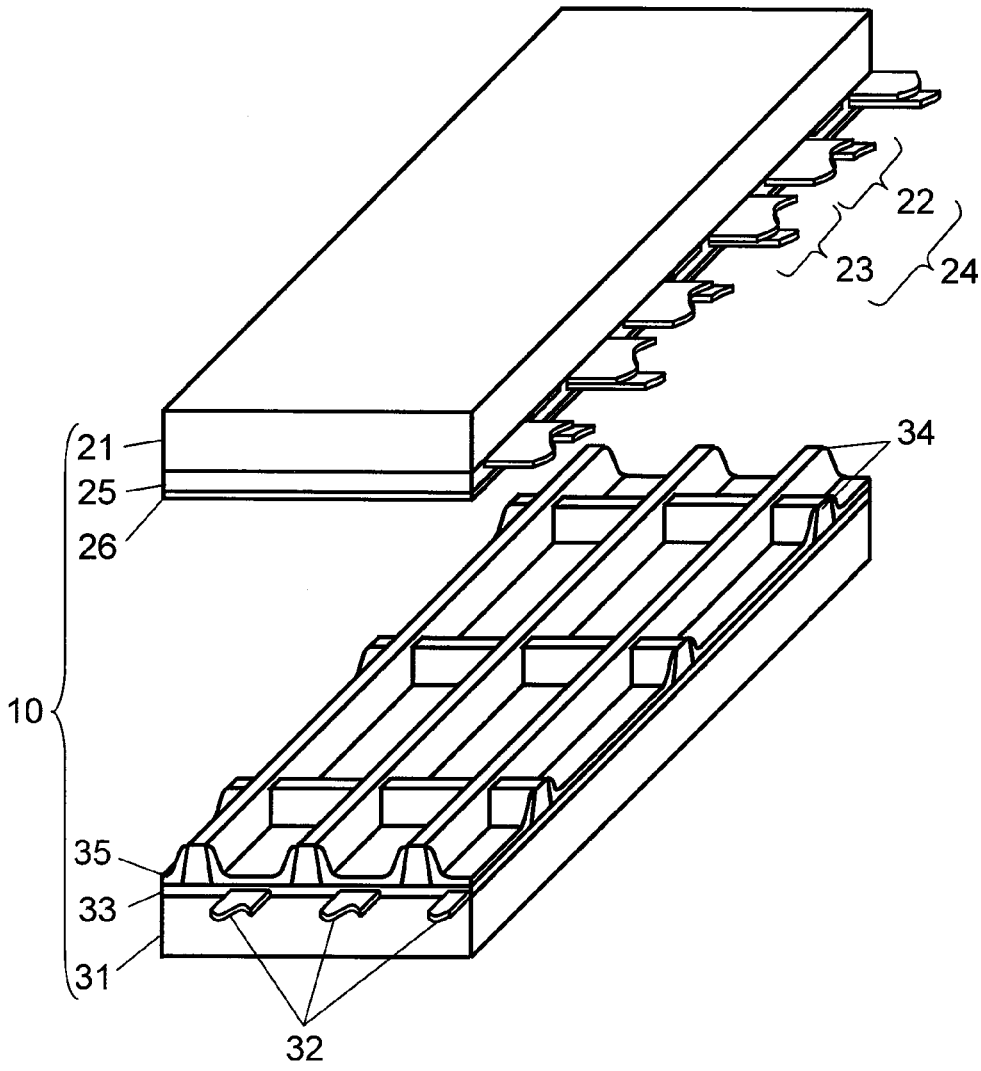
FIG. 1 is an exploded perspective view showing a structure of a panel in accordance with an exemplary embodiment of the present invention.

1 Plasma display device
10 Panel
21 Front plate
22 Scan electrode
23 Sustain electrode
24 Display electrode pair
25, 33 Dielectric layer
26 Protective layer
31 Rear plate
32 Data electrode
34 Barrier rib
35 Phosphor layer
41 Image signal processing circuit
42 Data electrode driving circuit
43 Scan electrode driving circuit
44 Sustain electrode driving circuit
45 Timing generating circuit
50, 60 Sustain pulse generating circuit
51, 61 Electric power recovering circuit

52, 62 Clamping circuit
53 Ramp voltage generating circuit
54 Scan pulse generating circuit
55 First Miller integrating circuit
56 Second Miller integrating circuit
57 Third Miller integrating circuit
Q1, Q2, Q3, Q4, Q11, Q12, Q13, Q14, Q15, Q16, Q21, Q31, Q32, Q33, Q34, Q36, Q37, Q38, Q39, QH1 to QHn, QL1 to QLn Switching element
C1, C10, C11, C12, C21, C30, C31 Capacitor
L1, L30 Inductor
D1, D2, D12, D13, D21, D31, D32, D33 Diode
AG AND Gate
CP Comparator
R10, R11, R12, R13, R14 Resistor

DETAILED DESCRIPTION OF PREFERRED EMBODIMENT

Hereinafter, a description is provided of a plasma display device in accordance with an exemplary embodiment of the present invention, with reference to the accompanying drawings.

Exemplary Embodiment

FIG. 1 is an exploded perspective view showing a structure of panel 10 in accordance with the exemplary embodiment of the present invention. A plurality of display electrode pairs 24, each made of scan electrode 22 and sustain electrode 23, are formed on glass-made front plate 21. Dielectric layer 25 is formed to cover scan electrodes 22 and sustain electrodes 23. Protective layer 26 is formed over dielectric layer 25.

In order to lower a breakdown voltage in discharge cells, protective layer 26 is made of a material predominantly composed of MgO. MgO has proven performance as a panel material, and exhibits a large secondary electron emission coefficient and excellent durability when neon (Ne) and xenon (Xe) gas is charged.

A plurality of data electrodes 32 are formed on rear plate 31. Dielectric layer 33 is formed to cover data electrodes 32. Further, on the dielectric layer, barrier ribs 34 are formed in a mesh pattern. Over the side faces of barrier ribs 34 and dielectric layer 33, phosphor layers 35 for emitting red (R), green (G), and blue (B) light are provided.

These front plate 21 and rear plate 31 are faced to each other sandwiching a small discharge space therebetween so that display electrode pairs 24 intersect with data electrodes 32. The outer peripheries of the plates are sealed with a sealing material, such as a glass frit. In the inside discharge space, a mixed gas of neon and xenon is charged as a discharge gas. In this exemplary embodiment, a discharge gas having a xenon partial pressure of approximately 10% is used to improve the emission efficiency. The discharge space is partitioned into a plurality of compartments by barrier ribs 34. Discharge cells are formed at intersections between display electrode pairs 24 and data electrodes 32. Discharging and lighting in these discharge cells enables image display.

The structure of panel 10 is not limited to the above, and may include barrier ribs formed in a stripe pattern. The mixing ratio of the discharge gas is not limited to the above value, and another mixing ratio can be used.

Figure 2:
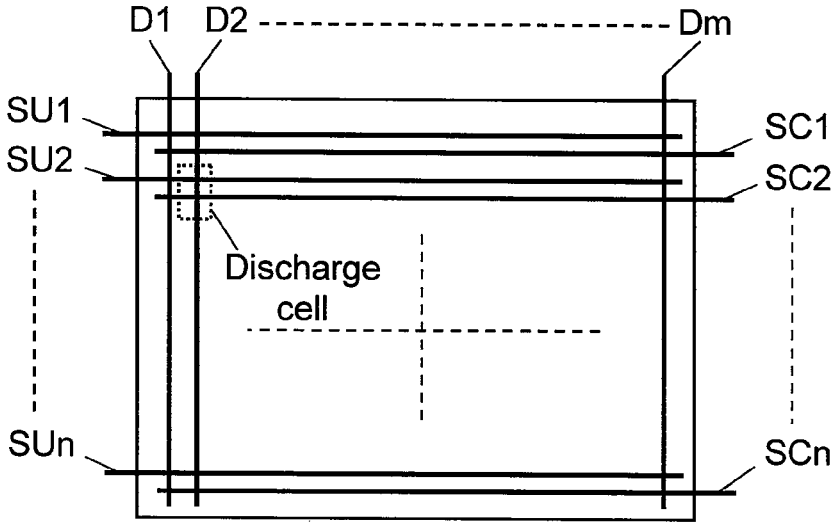
FIG. 2 is a diagram showing an array of electrodes of the panel.

FIG. 2 is a diagram showing an array of electrodes of panel 10 in accordance with the exemplary embodiment of the present invention. Panel 10 includes n scan electrodes SC1 to SCn (scan electrodes 22 in FIG. 1) and n sustain electrodes SU1 to SUn (sustain electrodes 23 in FIG. 1) both long in the row direction, and m data electrodes D1 to Dm (data electrodes 32 in FIG. 1) long in the column direction. A discharge cell is formed in the portion where a pair of scan electrode SCi (i=1 to n) and sustain electrode SUi intersects with one data electrode Dj (j=1 to m). Thus, m×n discharge cells are formed in the discharge space. As shown in FIG. 1 and FIG. 2, scan electrode SCi and sustain electrode SUi are formed in pairs in parallel with each other. Thus, large interelectrode capacitance Cp exists between scan electrodes SC1 to SCn, and sustain electrodes SU1 to SUn, respectively.

Next, driving voltage waveforms for driving panel 10 are described and the operation thereof is outlined.

A plasma display device of this exemplary embodiment provides gradation display by a subfield method: one field is divided into a plurality of subfields and whether to light the respective discharge cells or not is controlled for each of the subfields. Each subfield has an initializing period, an address period, and a sustain period.

For each subfield, in the initializing period, initializing discharge is caused to form wall charge necessary for the succeeding address discharge, on the respective electrodes. The initializing discharge also works to generate priming particles (priming for discharge=excitation particles) for reducing discharge delay and causing stable address discharge. The initializing operations performed at this time include an all-cell initializing operation for causing initializing discharge in all the discharge cells, and a selective initializing operation for selectively causing initializing discharge only in the discharge cells having generated sustain discharge in the preceding subfield.

In the address period, address discharge is caused to form wall charge selectively in the discharge cells to be lit in the succeeding sustain period. In the sustain period, applying a number of sustain pulses proportional to a luminance weight alternately to the electrodes of display electrode pairs 24 causes sustain discharge for light emission in the discharge cells having generated address discharge. A proportionality factor to be used at this time is called "luminance magnification".

In this exemplary embodiment, a ramp voltage is generated at the end of each sustain period, which stabilizes the address operation in the address period of the succeeding subfield (SF).

In this exemplary embodiment, one field is formed of 11 subfields (the first SF, and second SF to eleventh SF), and the respective subfields have luminance weights of 0.5, 1, 2, 3, 6, 11, 18, 30, 44, 60, and 80, for example. In this exemplary embodiment, a luminance weight of 1 indicates the emission luminance provided at one time of sustain discharge caused by application of a positive waveform voltage to scan electrodes SC1 to SCn or at one time of sustain discharge caused by application of a positive waveform voltage to sustain electrodes SU1 to SUn. A luminance weight of 0.5 in the first SF indicates light emission weaker than the light emitted at one time of sustain discharge. The detailed descriptions thereof are given later. In this exemplary embodiment, in the sustain period having a luminance weight of 0.5, no sustain discharge is generated but discharge is caused only by application of the above ramp voltage. This operation can make the luminance related to image display in the first SF lower than the emission luminance provided at one time of sustain discharge, thus allowing finer gradation and smoother image to be displayed.

The all-cell initializing operation is performed in the initializing period of the second SF (hereinafter, a subfield in which the all-cell initializing operation is performed being referred to as "all-cell initializing subfield"). The selective initializing operation is performed in the initializing periods of the first SF, and the third to eleventh SFs (hereinafter, a subfield in which the selective initializing operation is performed being referred to as "selective initializing subfield"). In this subfield structure, the light emission unrelated to image display is only the light emission caused by the discharge in the all-cell initializing operation in the second SF. Thus, a black picture level, i.e. luminance in an area displaying a black picture that causes generation of no sustain discharge, is provided only by weak light emission in the all-cell initializing operation. As a result, an image having a high contrast can be displayed. In the sustain period of each subfield, sustain pulses in a number equal to the luminance weight of the subfield multiplied by a predetermined luminance magnification are applied to each of display electrode pairs 24.

Hereinafter, the driving voltage waveforms are outlined, and next the structures of the driving circuits are described.

Figure 3:
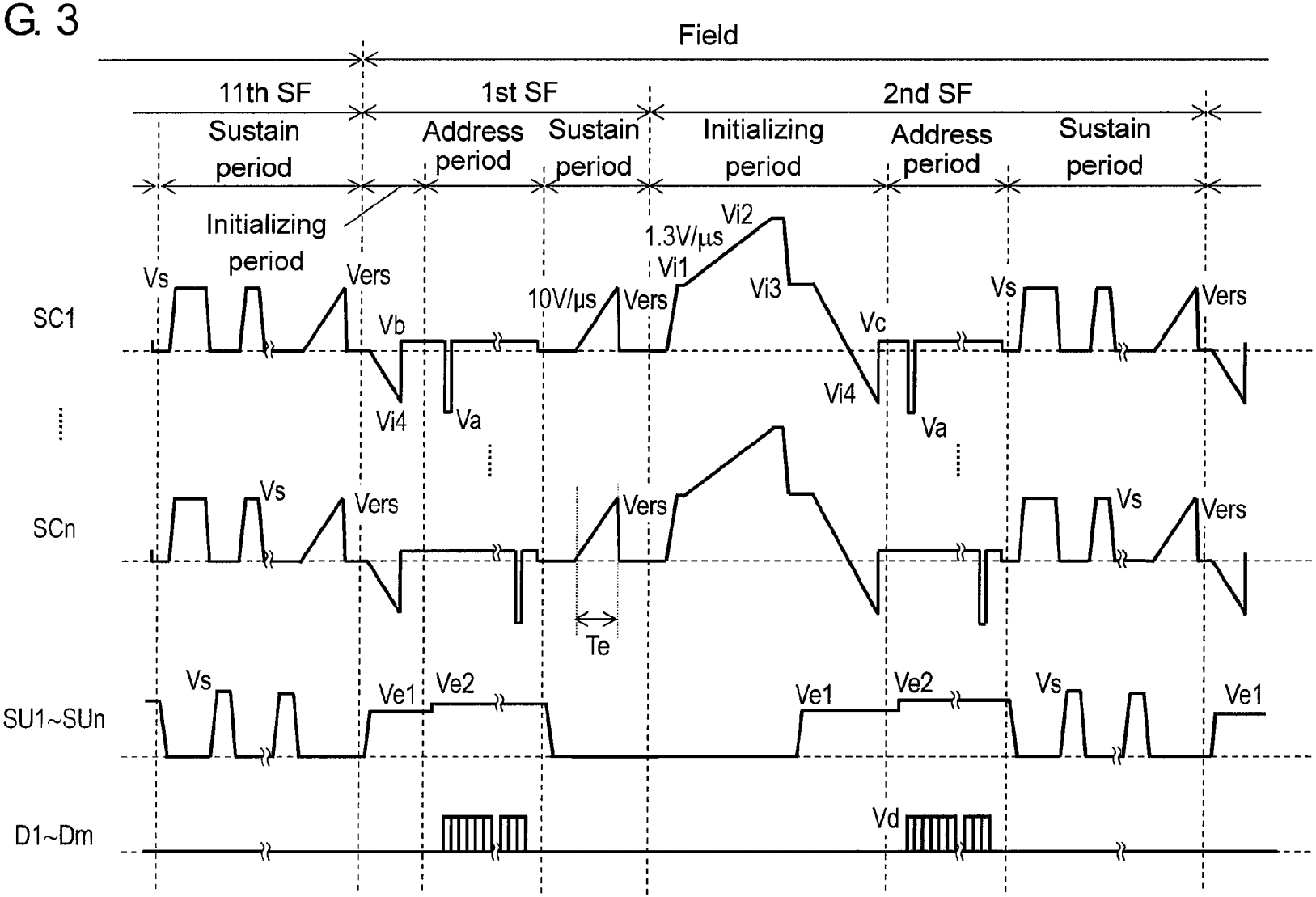
FIG. 3 is a waveform chart showing driving voltages to be applied to the respective electrodes of the panel.

FIG. 3 is a waveform chart showing driving voltages to be applied to the respective electrodes of panel 10 in accordance with the exemplary embodiment of the present invention. FIG. 3 shows driving voltage waveforms in two subfields: the first SF, i.e. a selective initializing subfield; and the second SF, i.e. an all-cell initializing subfield. However, the exemplary embodiment is not limited to the above descriptions of the subfield structure, the number of subfields, the luminance weight of each subfield, or the like. The subfield structure may be switched according to an image signal, or the like. In the following descriptions, scan electrode SCi, sustain electrode SUi, and data electrode Dk show the electrodes selected from the corresponding electrodes according to image data.

First, in the sustain period of the last subfield (the eleventh SF) of one field, sustain pulses in a number corresponding to the luminance weight are applied alternately to the electrodes of each display electrode pair 24. Thereafter, as shown in FIG. 3, while data electrodes D1 to Dm and sustain electrodes SU1 to SUn are kept at 0 (V), a second ramp voltage to be described later is applied to scan electrodes SC1 to SCn. Then, weak discharge is continuously caused between scan electrodes SC1 to SCn and sustain electrodes SU1 to SUn, respectively. Thus, a part or the whole of the wall voltages on scan electrode SCi and sustain electrode SUi is erased while a positive wall voltage is left on data electrode Dk. The wall voltages on the electrodes represent the voltages generated by the wall charges accumulated on the dielectric layers, protective layer, phosphor layers, or the like covering the electrodes.

The succeeding field, i.e. the first SF, is a selective initializing subfield. In the initializing period in which a selective initializing operation is performed, while data electrodes D1 to Dm are kept at 0 (V), a positive voltage of Ve1 is applied to sustain electrodes SU1 to SUn. Applied to scan electrodes SC1 to SCn is a ramp voltage (hereinafter, "decreasing ramp voltage") that gently decreases from a voltage (e.g. ground electric potential) equal to or lower than a breakdown voltage to a voltage Vi4 exceeding the breakdown voltage with respect to sustain electrodes SU1 to SUn. With this voltage application, in the discharge cells having generated discharge in the sustain period of the preceding subfield, weak initializing discharge occurs between scan electrodes SCi and sustain electrode SUi, and between scan electrode SCi and data electrodes Dk. This weak discharge weakens the wall voltage on scan electrode SCi and sustain electrode SUi, and adjusts the positive wall voltage on data electrodes D1 to Dm to a value appropriate for the address operation. On the other hand, in the discharge cells having generated no discharge in the sustain period of the preceding subfield, no discharge occurs and the wall charge at the completion of the initializing period of the preceding subfield is maintained.

In the succeeding address period, first, a voltage Ve2 is applied to sustain electrodes SU1 to SUn, and a voltage Vc is applied to scan electrodes SC1 to SCn.

Next, a negative scan pulse voltage Va is applied to scan electrode SC1 in the first row, and a positive address pulse voltage Vd is applied to data electrode Dk (k=1 to m) of the discharge cell to be lit in the first row among data electrodes D1 to Dm. At this time, the voltage difference at the intersection between data electrode Dk and scan electrode SC1 is the addition of the difference in an externally applied voltage (Vd-Va) and the difference between the wall voltage on data electrode Dk and the wall voltage on scan electrode SC1. Thus, the voltage difference exceeds the breakdown voltage. Then, discharge occurs between data electrodes Dk and scan electrode SC1. On the other hand, because the voltage Ve2 is applied to sustain electrodes SU1 to SUn, the voltage difference between sustain electrode SU1 and scan electrode SC1 is the addition of the difference in an externally applied voltage (Ve2-Va) and the difference between the wall voltage on sustain electrode SU1 and the wall voltage on scan electrode SC1. At this time, setting the voltage Ve2 to a value slightly lower than the breakdown voltage can make a state in which discharge is likely to occur but not actually occurs between sustain electrode SU1 and scan electrode SC1. With this setting, discharge generated between data electrode Dk and scan electrode SC1 can trigger discharge between the areas of sustain electrode SU1 and scan electrode SC1 intersecting with data electrode Dk. In this manner, address discharge occurs in the discharge cells to be lit. Positive wall voltage accumulates on scan electrode SC1 and negative wall voltage accumulates on sustain electrode SU1. Negative wall voltage also accumulates on data electrode Dk.

In this manner, the address operation is performed to cause address discharge in the discharge cells to be lit in the first row and to accumulate wall voltages on the respective electrodes. On the other hand, the voltage at the intersections between data electrodes D1 to Dm subjected to no address pulse voltage Vd and scan electrode SC1 does not exceed the breakdown voltage, thus causing no address discharge. The above address operation is performed on the discharge cells up to the n-th row and the address period is completed.

As described above, the luminance weight of the first SF is set to 0.5. Thus, in the succeeding sustain period, only continuous weak discharge is caused by application of the second ramp voltage (hereinafter, "erasing ramp voltage") to ones (herein, scan electrodes SC1 to SCn) of display electrode pairs 24. This discharge also erases a part or the whole of the wall voltages on scan electrode SCi and sustain electrode SUi while the positive voltage is left on data electrode Dk.

Specifically, data electrodes D1 to Dm and sustain electrodes SU1 to SUn are kept at 0 (V). At the same time, the erasing ramp voltage, i.e. the second ramp voltage that increases from a base electric potential of 0 (V) toward a voltage Vers exceeding the breakdown voltage, is generated with a gradient of approximately 10 V/μsec, for example, which is steeper than that of a first ramp voltage to be described later. The erasing ramp voltage is applied to scan electrodes SC1 to SCn. Then, in the discharge cells having generated address discharge, the voltage difference between scan electrode SCi and sustain electrode SUi amounts to the addition of the erasing ramp voltage and the difference between the wall voltage on scan electrode SCi and the wall voltage on sustain electrode SUi. Thus, the voltage difference exceeds the breakdown voltage while the erasing ramp voltage is increasing. As a result, weak discharge occurs between scan electrode SCi and sustain electrode SUi. This weak discharge continues while the erasing ramp voltage is increasing. When the increasing voltage reaches a predetermined voltage of Vers, the voltage applied to scan electrodes SC1 to SCn is dropped to the base electric potential, 0 (V).

The charged particles generated by this discharge accumulate on sustain electrode SUi and scan electrode SCi as wall charges so as to alleviate the voltage difference between sustain electrode SUi and scan electrode SCi. This accumulation weakens the difference between the wall voltage on scan electrodes SC1 to SCn and the wall voltage on sustain electrodes SU1 to SUn to a degree of the difference between the voltage applied to scan electrode SCi and the breakdown voltage, i.e. the voltage Vers—the breakdown voltage, while the positive wall charge is left on data electrode Dk. Hereinafter, the last discharge in each sustain period generated by this erasing ramp voltage is referred to as "erasing discharge".

In this exemplary embodiment, the gradient of the erasing ramp voltage (e.g. approximately 10 V/μsec) is set steeper than the gradient of the first ramp voltage in the all-cell initializing operation. This setting is defined so that stable erasing discharge is generated to appropriately adjust the wall charges, and the drive waveform fits into a predetermined sustain period. On the other hand, the erasing ramp voltage having a gradient gentler than that of the rising edge of the sustain pulse and steeper than that of the first ramp voltage allows the erasing discharge to occur at a discharge intensity weaker than that of the sustain discharge and greater than that of the initializing discharge in the all-cell initializing operation. In other words, discharge to be generated in the sustain period is only the erasing discharge caused by this erasing ramp voltage. This operation allows the discharge cells to emit light at a luminance lower than that provided by one time of sustain discharge. In this exemplary embodiment, this operation provides a luminance weight of 0.5 in the first SF and reduces the luminance related to image display in the first SF, thus allowing finer gradation to be displayed.

In this exemplary embodiment, the emission luminance at a luminance weight of 0.5 does not mean to be a half the emission luminance provided at one time of sustain discharge, but simply means to be smaller than the emission luminance at a luminance weight of 1. In this exemplary embodiment, the emission luminance in the subfield having a luminance weight of 0.5 only needs to be smaller than the emission luminance provided at one time of sustain discharge. For example, the emission luminance at a luminance weight of 0.5 may be 0.3, 0.4, 0.6, or 0.7 times the emission luminance provided at one time of sustain discharge.

In this exemplary embodiment, immediately after the voltage applied to scan electrodes SC1 to SCn has reached the voltage Vers, the voltage is dropped to the base electric potential, 0 (V). This structure is based on experimental results in which when an increasing voltage reaches the voltage Vers and the voltage is kept thereafter, abnormal electric discharge is likely to occur in a discharge cell satisfying the following three conditions where:

1. the discharge cell is an unlit discharge cell (i.e. a discharge cell not addressed in the subfield);

2. an adjacent cell of the discharge cell is a lit discharge cell (i.e. a discharge cell addressed in the subfield); and 3. the discharge cell has generated sustain discharge in the preceding subfield.

Because this abnormal electric discharge induces erroneous discharge in the succeeding address period, it is preferable to minimize the occurrence of the abnormal electric discharge.

In this exemplary embodiment, in generation of the erasing ramp voltage, immediately after the voltage applied to scan electrodes SC1 to SCn has reached the voltage Vers, the voltage is dropped to the base electric potential, 0 (V). With this structure, the priming particles generated by the erasing discharge can immediately converge (the priming particles formed in the discharge space can settle in the discharge cells as wall charges). In contrast, in the structure where after the voltage applied to scan electrodes SC1 to SCn has reached the voltage Vers, the voltage is kept for a predetermined time period, the priming particles generated by the erasing discharge take more time to converge. Compared to such a structure, the structure of this exemplary embodiment can stabilize the wall charges and the initializing discharge to be caused thereafter, particularly the initializing discharge to be caused by a decreasing ramp voltage in the selective discharge operation. Thus, the wall voltages in the discharge cells can be adjusted to be optimum for stabilizing the succeeding address operation, while the occurrence of abnormal electric discharge in the initializing operation is prevented.

In this exemplary embodiment, the value of the voltage Vers is set to a sustain pulse voltage Vs+3 (V), e.g. approximately 213 (V). Preferably, the value of the voltage Vers is set in the voltage range of the sustain pulse voltage Vs−10 (V) to the sustain pulse voltage Vs+10 (V). When the value of the voltage Vers is higher than the upper limit, the wall voltage is excessively adjusted. When the value is lower than the lower limit, adjustment of the wall voltage becomes insufficient. Therefore, the stable address operation may not be executed in both cases.

In this exemplary embodiment, the gradient of the erasing ramp voltage is set to approximately 10 V/μsec. Preferably, this gradient is set in the range of 2 V/μsec to 20 V/μsec. When this gradient is steeper than the upper limit, discharge for adjusting the wall voltage is not weak. When this gradient is gentler than the lower limit, the discharge becomes very weak. Therefore adjustment of the wall voltage may not be executed appropriately in both cases.

In the discharge cells having generated no address discharge in the address period, no erasing discharge occurs and the wall charges at the completion of the initializing period are maintained.

The succeeding second SF is a subfield in which an all-cell initializing operation is performed. In the first half of the initializing period in the second SF, 0 (V) is applied to respective data electrodes D1 to Dm and sustain electrodes SU1 to SUn. Applied to scan electrodes SC1 to SCn is the first ramp voltage (hereinafter, "increasing ramp voltage") that gently increases from a voltage Vi1 of the breakdown voltage or lower to a voltage Vi2 exceeding the breakdown voltage with respect to sustain electrodes SU1 to SUn. This increasing ramp voltage is a voltage in which the voltage difference between scan electrodes SC1 to SCn and sustain electrodes SU1 to SUn gently increases from the voltage Vi1 of the breakdown voltage or lower to the voltage Vi2 exceeding the breakdown voltage.

While this ramp voltage is increasing, weak initializing discharge continuously occurs between scan electrodes SC1 to SCn and sustain electrodes SU1 to SUn, and between scan electrodes SC1 to SCn and data electrodes D1 to Dm, respectively. Then, negative wall voltage accumulates on scan electrodes SC1 to SCn. Positive wall voltage accumulates on data electrodes D1 to Dm and sustain electrodes SU1 to SUn.

In this exemplary embodiment, this increasing ramp voltage is generated with a gradient of approximately 1.3 V/μsec so that the light emission caused by the all-cell initializing operation does not increase the black picture level, and stable initializing discharge is caused.

In the second half of the initializing period, the positive voltage of Ve1 is applied to sustain electrodes SU1 to SUn. A voltage of 0 (V) is applied to data electrodes D1 to Dm. Applied to scan electrodes SC1 to SCn is a decreasing ramp voltage that gently decreases from a voltage Vi3 of the breakdown voltage or lower to the voltage Vi4 exceeding the breakdown voltage with respect to sustain electrodes SU1 to SUn. This decreasing ramp voltage is a voltage in which the voltage difference between scan electrodes SC1 to SCn and sustain electrodes SU1 to SUn gently decreases from the voltage Vi3 of the breakdown voltage or lower to the voltage Vi4 exceeding the breakdown voltage. During this application, weak initializing discharge continuously occurs between scan electrodes SC1 to SCn and sustain electrodes SU1 to SUn, and between scan electrodes SC1 to SCn and data electrodes D1 to Dm, respectively. This weak discharge weakens the negative wall voltage on scan electrodes SC1 to SCn and the positive wall voltage on sustain electrodes SU1 to SUn, and adjusts the positive wall voltage on data electrodes D1 to Dm to a value appropriate for the address operation.

Thus, the all-cell initializing operation for causing initializing discharge in all the discharge cells is completed. In this exemplary embodiment, the wall charges in the discharge cells are sufficiently alleviated by the preceding erasing discharge. This erasing discharge makes initializing discharge weaker than that in an otherwise case. This structure can suppress unnecessary light emission caused in the initializing discharge and thus suppress an increase in black picture level.

As described above, in this exemplary embodiment, the third to eleventh SFs are selective initializing subfields like the first SF. Thus, in the third to eleventh SFs, as shown in the initializing period of the first SF in FIG. 3, driving voltage waveforms in which the first half of the initializing period of the second SF is omitted are applied to the respective electrodes. In other words, the voltage Ve1 is applied to sustain electrodes SU1 to SUn, and 0 (V) is applied to data electrode D1 to Dm. The decreasing ramp voltage gently decreasing from a voltage of the breakdown voltage or lower (e.g. ground electric potential) to the voltage Vi4 is applied to scan electrodes SC1 to SCn. This voltage application causes weak initializing discharge in the discharge cells having generated sustain discharge in the sustain period of the preceding subfield and weakens the negative wall voltage on scan electrodes SC1 to SCn and the positive wall voltage on sustain electrodes SU1 to SUn. In the discharge cells in which sufficient positive wall voltage is accumulated on data electrode Dk (k=1 to m) by the preceding sustain discharge, an excessive part of this wall voltage is discharged and adjusted appropriately for the address operation. In the discharge cells having generated no sustain discharge in the preceding subfield, no discharge occurs and the wall charges at the completion of the initializing period of the preceding subfield are maintained.

The operation in the succeeding address period is the same as that in the address period of the first SF. Thus, the descriptions thereof are omitted.

In the succeeding sustain period, first, the positive sustain pulse voltage Vs is applied to scan electrodes SC1 to SCn, and a ground electric potential to be the base electric potential, i.e. 0 (V), is applied to sustain electrodes SU1 to SUn. Then, in the discharge cells having generated address discharge, the voltage difference between scan electrode SCi and sustain electrode SUi amounts to the addition of the sustain pulse voltage Vs and the difference between the wall voltage on scan electrode SCi and the wall voltage on sustain electrode SUi. Thus, the voltage difference exceeds the breakdown voltage.

Thus, sustain discharge occurs between scan electrode SCi and sustain electrode SUi, and ultraviolet light generated at this time causes phosphor layers 35 to emit light. Then, negative wall voltage accumulates on scan electrode SCi, and positive wall voltage accumulates on sustain electrodes SUi. Positive wall voltage also accumulates on data electrode Dk. In the discharge cells having generated no address discharge in the address period, no sustain discharge occurs and the wall voltages at the completion of the initializing period are maintained.

Next, the base electric potential, 0 (V), is applied to scan electrodes SC1 to SCn, and the sustain pulse voltage Vs is applied to sustain electrodes SU1 to SUn. Then, in the discharge cell having generated sustain discharge, the voltage difference between sustain electrode SUi and scan electrode SCi exceeds the breakdown voltage, thus causing sustain discharge between sustain electrode SUi and scan electrode SCi again. Thereby, negative wall voltage accumulates on sustain electrode SUi, and positive wall voltage on scan electrode SCi. Similarly, sustain pulses in a number equal to the luminance weight multiplied by the luminance magnification are applied alternately to scan electrodes SC1 to SCn and sustain electrodes SU1 to SUn to give a electric potential difference between the electrodes of each display electrode pair 24. Thus, sustain discharge is continually caused in the discharge cells having generated address discharge in the address period.

At the end of the sustain period, while data electrodes D1 to Dm and sustain electrodes SU1 to SUn are kept at 0 (V), the erasing ramp voltage is applied to scan electrodes SC1 to SCn. This operation continuously causes weak discharge between scan electrodes SC1 to SCn and sustain electrodes SC1 to SCn, respectively, and erases a part or the whole of the wall voltages on scan electrode SCi and sustain electrode SUi while the positive wall voltage is left on data electrode Dk.

The erasing discharge in the second SF has the same function as the erasing discharge in the eleventh and first SFs described above. The descriptions of the operation in the succeeding subfields are omitted, because the operation is substantially similar to the operation described above except for the numbers of sustain pulses in the sustain periods. The above descriptions have outlined the driving voltage waveforms to be applied to the respective electrodes of panel 10 in this exemplary embodiment.

Figure 4:
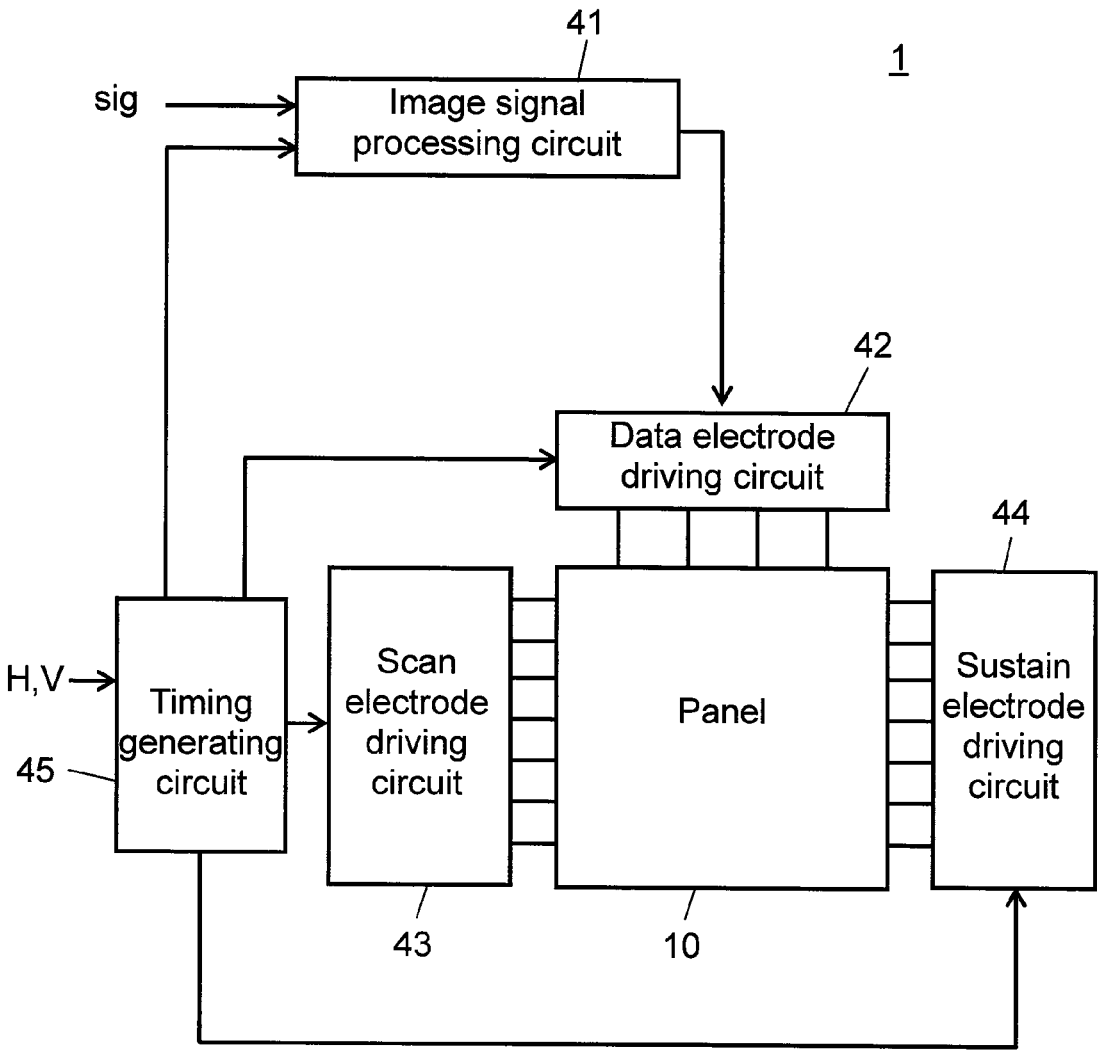
FIG. 4 is a circuit block diagram of a plasma display device in accordance with the exemplary embodiment of the present invention.

Next, a description is provided of the structure of a plasma display device in accordance with this exemplary embodiment. FIG. 4 is a circuit block diagram of the plasma display device in accordance with the exemplary embodiment of the present invention. Plasma display device 1 includes panel 10, image signal processing circuit 41, data electrode driving circuit 42, scan electrode driving circuit 43, sustain electrode driving circuit 44, timing generating circuit 45, and electric power supply circuits (not shown) for providing power supplies necessary for the respective circuit blocks.

Image signal processing circuit 41 converts a supplied image signal sig into image data showing whether to light the discharge cells or not for each subfield. Data electrode driving circuit 42 converts the image data for each subfield into signals corresponding to data electrodes D1 to Dm, and drives respective data electrodes D1 to Dm.

Timing generating circuit 45 generates various types of timing signals for controlling the operation of the respective circuit blocks according to a horizontal synchronizing signal H and a vertical synchronizing signal V, and supplies the timing signals to the respective circuit blocks. As described above, in this exemplary embodiment, at the end of each sustain period, the erasing ramp voltage is generated. The timing signals according to the erasing ramp voltage are supplied to scan electrode driving circuit 43 and sustain electrode driving circuit 44. This structure can stabilize initializing discharge and address operation.

Scan electrode driving circuit 43 includes the following elements: a ramp voltage generating circuit for generating initializing voltages to be applied to scan electrodes SC1 to SCn in the initializing periods; a sustain pulse generating circuit (not shown) for generating a sustain pulse to be applied to scan electrodes SC1 to SCn in the sustain periods; and a scan pulse generating circuit (not shown) for generating scan pulse voltages to be applied to scan electrodes SC1 to SCn in the address periods. The scan electrode driving circuit drives respective scan electrodes SC1 to SCn in response to the timing signals. Sustain electrode driving circuit 44 includes a sustain pulse generating circuit (not shown) and a circuit for generating the voltage Ve1 and voltage Ve2, and drives sustain electrodes SU1 to SUn in response to the timing signals.

Figure 5:
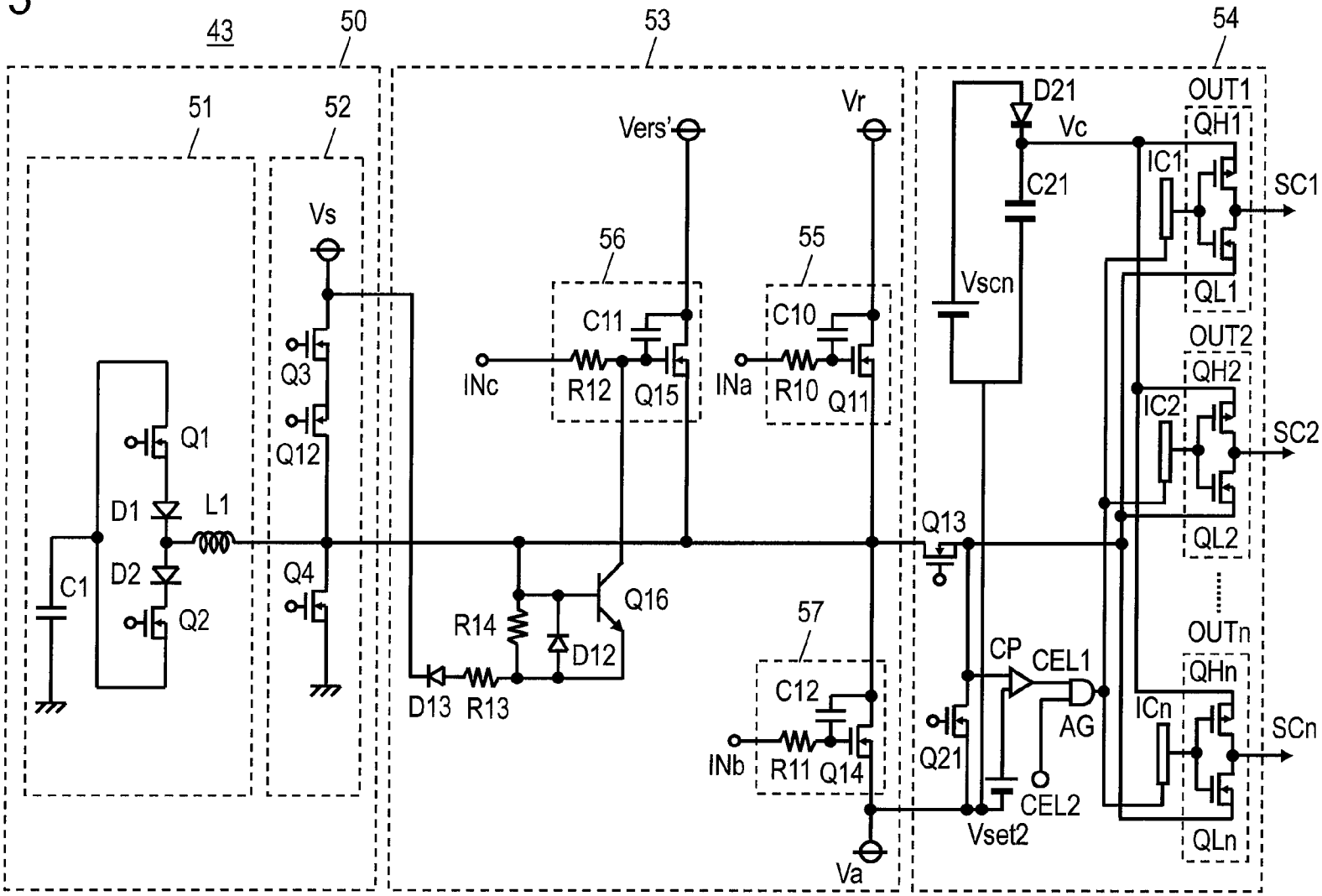
FIG. 5 is a circuit diagram of a scan electrode driving circuit in accordance with the exemplary embodiment of the present invention.

Next, a description is provided of scan electrode driving circuit 43. FIG. 5 is a circuit diagram of scan electrode driving circuit 43 in accordance with the exemplary embodiment of the present invention. Scan electrode driving circuit 43 includes the following elements: sustain pulse generating circuit 50 for generating the sustain pulse to be applied to scan electrodes SC1 to SCn in the sustain periods; ramp voltage generating circuit 53 for generating the initializing waveforms to be applied to scan electrodes SC1 to SCn in the initializing periods; and scan pulse generating circuit 54 for generating the scan pulse to be applied to scan electrodes SC1 to SCn in the address periods. FIG. 5 shows a separator circuit formed of switching element Q12 for electrically separating a electric power supply voltage Vs of the sustain pulse generating circuit from ramp voltage generating circuit 53 in the operation of ramp voltage generating circuit 53, and a separator circuit formed of switching element Q13 for electrically separating ramp voltage generating circuit 53 from scan pulse generating circuit 54 in generation of the scan pulse. In the following descriptions, the operation of bringing a switching element into conduction is indicated as "ON", and the operation of bringing out of conduction is indicated as "OFF". The signal for turning on a switching element is indicated as "Hi", and the signal for turning off is indicated as "Lo".

Sustain pulse generating circuit 50 includes electric power recovering circuit 51 and clamping circuit 52. Electric power recovering circuit 51 includes electric power recovering capacitor C1, switching element Q1, switching element Q2, blocking diode D1, blocking diode D2, and resonance inductor L1. Electric power recovering capacitor C1 has a capacitance sufficiently larger than interelectrode capacitance Cp and is charged at approximately Vs/2, i.e. a half of the voltage Vs, to work as the electric power supply for electric power recovering circuit 51. Clamping circuit 52 includes switching element Q3 for clamping scan electrodes SC1 to SCn to the voltage Vs, and switching element Q4 for clamping scan electrodes SC1 to SCn to the base electric potential, 0 (V). Then, the sustain pulse generating circuit generates the sustain pulse voltage Vs by switching the respective switching elements in response to the timing signals supplied from timing generating circuit 45.

In sustain pulse generating circuit 50, when a sustain pulse is caused to rise, for example, switching element Q1 is turned on to cause resonance between interelectrode capacitance Cp and inductor L1 so that power is supplied from electric power recovering capacitor C1 to scan electrodes SC1 to SCn through switching element Q1, diode D1, and inductor L1. At a point when the voltage of scan electrodes SC1 to SCn approaches the voltage Vs, switching element Q3 is turned on so that scan electrodes SC1 to SCn are clamped to the voltage Vs. A metal-oxide semiconductor field-effect-transistor (MOSFET) has a parasitic diode called a body diode that is formed in anti-parallel with the portion performing switching operation (that is in parallel with the portion performing switching operation and has a forward-bias direction opposite to the direction in which the switching operation draws current). For this reason, even when switching element Q12 is turned off, turning on switching element Q3 allows scan electrodes SC1 to SCn to be clamped to the voltage Vs via this body diode.

Inversely, when the sustain pulse is caused to fall, switching element Q2 is turned on to cause resonance between interelectrode capacitance Cp and inductor L1 so that power is recovered from interelectrode capacitance Cp to electric power recovering capacitor C1 through inductor L1, diode D2, and switching element Q2. At a point when the voltage of scan electrodes SC1 to SCn approaches 0 (V), switching element Q4 is turned on so that scan electrodes SC1 to SCn are clamped to the base electric potential, 0 (V).

In this exemplary embodiment, a second ramp voltage generating circuit for generating the erasing ramp voltage is provided separately from a first ramp voltage generating circuit for generating the increasing ramp voltage in the initializing operation. Specifically, ramp voltage generating circuit 53 includes first Miller integrating circuit 55, second Miller integrating circuit 56, and third Miller integrating circuit 57. The first Miller integrating circuit is the first ramp voltage generating circuit that includes switching element Q11, capacitor C10, and resistor R10, and generates the increasing ramp voltage gently increasing to the voltage Vi2 in a ramp form. The second Miller integrating circuit is the second ramp voltage generating circuit that includes switching element Q15, capacitor C11, and resistor R12, and generates the erasing ramp voltage gently increasing to the voltage Vers with a gradient gentler than that of the rising edge of the sustain pulse but steeper than that of the first ramp voltage. The third Miller integrating circuit is a third ramp voltage generating circuit that includes switching element Q14, capacitor C12, and resistor R11, and generates the decreasing ramp voltage gently deceasing to the voltage Vi4 in a ramp form. In FIG. 5, the input terminals of these Millar integrating circuits are shown as input terminal INa, input terminal INb, and input terminal INc.

In order to stop the voltage increase in generation of the erasing ramp voltage precisely at the voltage Vers, this exemplary embodiment includes a switching circuit that compares the erasing ramp voltage with a predetermined electric potential, and stops the operation of the second Miller integrating circuit for generating the erasing ramp voltage, immediately after the erasing ramp voltage has reached the predetermined electric potential. Specifically, the switching circuit includes the following elements: blocking diode D13; resistor R13 for adjusting the value of the voltage Vers; switching element Q16 for bringing input terminal INc of second Miller integrating circuit 56 into the "Lo" state when the voltage supplied from ramp voltage generating circuit 53 reaches the voltage Vers; protective diode D12; and resistor R14.

Switching element Q16 is formed of a generally used NPN transistor. The base thereof is connected to the output of ramp voltage generating circuit 53. The collector thereof is connected to input terminal INc of second Miller integrating circuit 56. The emitter thereof is connected to the voltage Vs via series-connected resistor R13 and diode D13. The resistance of resistor R13 is set so that switching element Q16 is turned on when the voltage supplied from ramp voltage generating circuit 53 reaches the voltage Vers. Thus, when the voltage supplied from ramp voltage generating circuit 53 reaches the voltage Vers, switching element Q16 is turned on.

Then, because the current to be fed into input terminal INc to operate second Miller integrating circuit 56 is extracted by switching element Q16, the operation of second Miller integrating circuit 56 is stopped.

Typically, the gradient of a ramp voltage generated by a Miller integrating circuit is susceptible to variations in the elements constituting the Miller integrating circuit. For this reason, when a ramp voltage is generated only by controlling the operation period of a Miller integrating circuit, the maximum value of the ramp voltage is likely to have variations. In this exemplary embodiment, it is confirmed that setting the maximum value of the erasing ramp voltage within ±3 (V) of the target voltage is preferable. With the structure of this exemplary embodiment, the maximum value of the erasing ramp voltage can fit in the range of ±approximately 1 (V) of the target voltage, and the erasing ramp voltage can be generated precisely.

Preferably, a voltage Vers' is set to a value higher than the voltage Vers. In this exemplary embodiment, the voltage Vers' is set to the voltage Vs+30 (V). In this exemplary embodiment, the resistance of resistor R13 is set so that the voltage Vers is equal to the voltage Vs+3 (V). Specifically, resistor R13 is set to 100 Ω, the voltage Vs to 210 (V), and resistor R14 to 1 kΩ. However, these values are set simply according to a 42-inch diagonal panel having 1,080 display electrode pairs, and can be set optimum for the characteristics of the panel and the specifications of the plasma display device.

Ramp voltage generating circuit 53 generates the above ramp voltages or erasing ramp voltage in response to the timing signals supplied from timing generating circuit 45.

For example, when the increasing ramp voltage in the initializing waveform is generated, a predetermined constant current is fed into input terminal INa, thus bringing input terminal INa into the "Hi" state. Then, constant current flows from resistor R10 toward capacitor C10, the source voltage of switching element Q11 increases in a ramp form, and the output voltage of scan electrode driving circuit 43 also begins to increase in a ramp form.

When the decreasing ramp voltage in the initializing waveforms is generated in the all-cell initializing operation and the selective initializing operation, a predetermined constant current is fed into input terminal INb, thus bringing input terminal INb into the "Hi" state. Then, constant current flows from resistor R11 toward capacitor C12, the drain voltage of switching element Q14 decreases in a ramp form, and the output voltage of scan electrode driving circuit 43 also begins to decrease in a ramp form.

When the erasing ramp voltage is generated at the end of each sustain period, a predetermined constant current is fed into input terminal INc, thus bringing input terminal INc into the "Hi" state. Then, constant current flows from resistor R12 toward capacitor C11, the source voltage of switching element Q15 increases in a ramp form, and the output voltage of scan electrode driving circuit 43 also begins to increase in a ramp form. In this exemplary embodiment, the resistance of resistor R12 is set smaller than the resistance of resistor R10. Thus, the erasing ramp voltage, i.e. the second ramp voltage, is generated with a gradient steeper than that of the increasing ramp voltage, i.e. the first ramp voltage.

When the driving voltage supplied from ramp voltage generating circuit 53 gradually increases and exceeds the voltage Vers, switching element Q16 is turned on. Then, the constant current to be fed into input terminal INc is extracted by switching element 16, and thus the operation of second Miller integrating circuit 56 is stopped. Thereby, the driving voltage supplied from ramp voltage generating circuit 53 is immediately dropped to the base electric potential, 0 (V). In this exemplary embodiment, immediately after the voltage increase in generation of the erasing ramp voltage is stopped precisely at the predetermined voltage Vers, the voltage is dropped to the base electric potential, 0 (V).

Scan pulse generating circuit 54 includes switch circuits OUT1 to OUTn, switching element Q21, control circuits IC1 to ICn, diode D21, and capacitor C21. Switch circuits OUT1 to OUTn output the scan pulse voltage to scan electrodes SC1 to SCn, respectively. Switching element Q21 clamps the low voltage sides of switch circuits OUT1 to OUTn to the voltage Va. Control circuits IC1 to ICn control switch circuits OUT1 to OUTn, respectively. Diode D21 and capacitor C21 are used to apply the voltage Vc, i.e. the resultant voltage of the voltage Va and a voltage Vscn superimposed thereon, to the high voltage sides of switch circuits OUT1 to OUTn. Switch circuits OUT1 to OUTn include switching elements QH1 to QHn for outputting the voltage Vc, and switching elements QL1 to QLn for outputting the voltage Va, respectively. In response to the timing signals supplied from timing generating circuit 45, the scan pulse generating circuit sequentially generates the scan pulse voltage Va to be applied to scan electrodes SC1 to SCn, respectively, in each address period. Scan pulse generating circuit 54 outputs the voltage waveforms in ramp voltage generating circuit 53 in the initializing periods, and the voltage waveforms in sustain pulse generating circuit 50 in the sustain periods without any change.

Because switching element Q3, switching element Q4, switching element Q12, and switching element Q13 carry extremely large current, a plurality of field-effect transistors (FETs), insulated gate bipolar transistors (IGBTs), or the like are connected in parallel with these switching elements to reduce the impedance thereof.

Further, scan pulse generating circuit 54 includes AND gate AG for performing AND operation, and comparator CP for comparing the values of input signals fed into two input terminals thereof. Comparator CP compares the resultant voltage of the voltage Va and a voltage Vset2 superimposed thereon, i.e. a voltage (Va+Vset2), with the driving voltage. When the driving voltage is higher than the voltage (Va+Vset2), comparator CP outputs "0". Otherwise, comparator CP outputs "1". Fed into AND gate AG are two input signals, i.e. an output signal CEL1 from comparator CP and a switching signal CEL2. For example, a timing signal supplied from timing generating circuit 45 can be used as the switching signal CEL2. AND gate AG outputs "1" when both input signals are "1". Otherwise, AND gate AG outputs "0". The output of AND gate AG is fed into control circuits IC1 to ICn. When the output of AND gate AG is "0", control circuits IC1 to ICn outputs the driving voltage via switching elements QL1 to QLn. When the output of AND gate AG is "1", control circuits IC1 to ICn outputs the voltage Vc, i.e. the resultant voltage of the voltage Va and the voltage Vscn superimposed thereon, via switching elements QH1 to QHn.

In this exemplary embodiment, each of the first ramp voltage generating circuit, the second ramp voltage generating circuit, and the third ramp voltage generating circuit is formed of an FET-based Miller integrating circuit that is practical and has a relatively simple structure. However, the ramp voltage generating circuits are not limited to the above structure. Any circuit may be used as long as the circuit is capable of generating an increasing ramp voltage and a decreasing ramp voltage.

Figure 6:
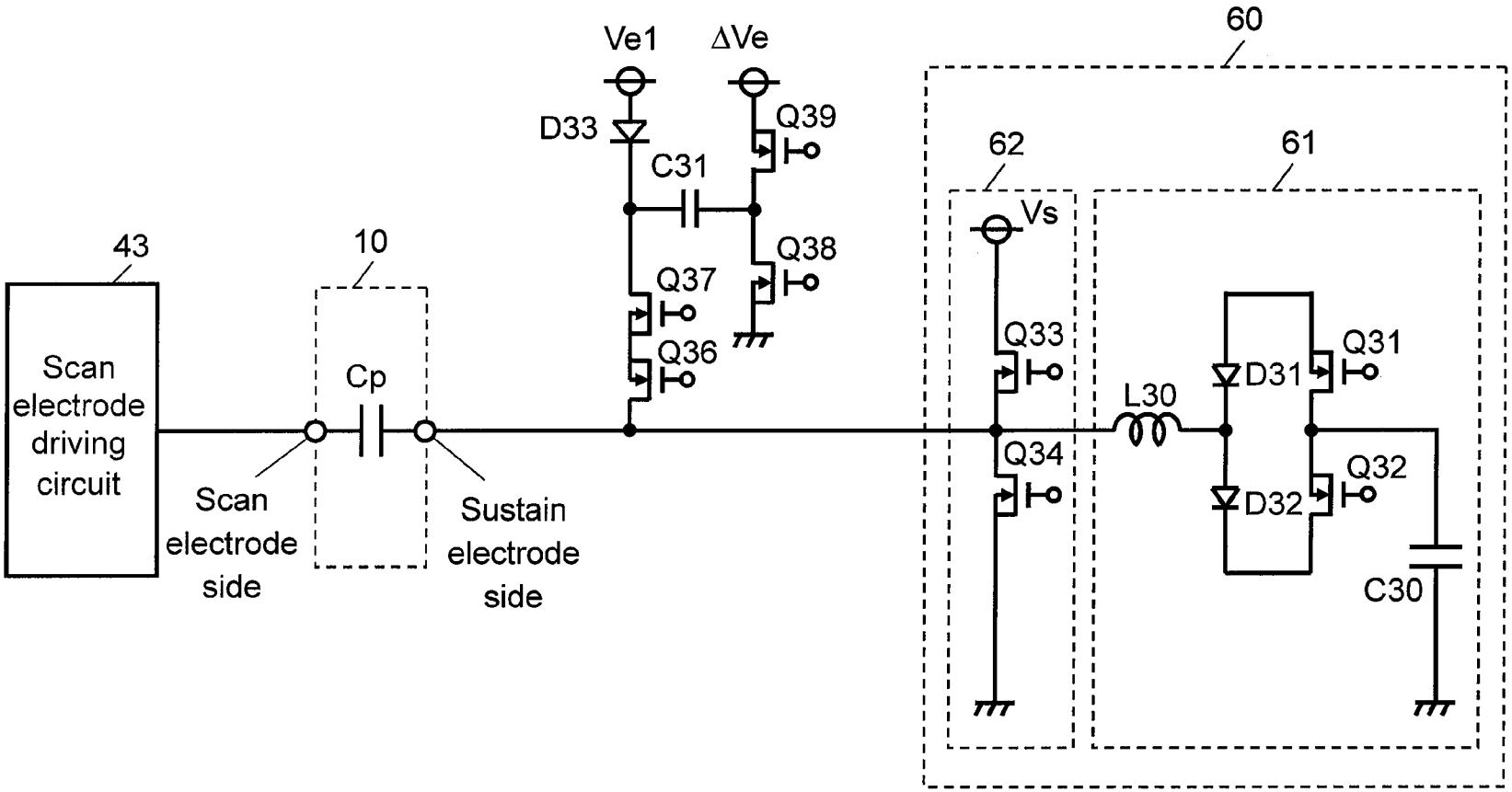
FIG. 6 is a circuit diagram of a sustain electrode driving circuit in accordance with the exemplary embodiment of the present invention.

Next, a description is provided of sustain electrode driving circuit 44. FIG. 6 is a circuit diagram of sustain electrode driving circuit 44 in accordance with the exemplary embodiment of the present invention. In FIG. 6, the interelectrode capacitance of panel 10 is represented by Cp.

Sustain pulse generating circuit 60 of sustain electrode driving circuit 44 is substantially similar in structure to sustain pulse generating circuit 50 of scan electrode driving circuit 43. Sustain pulse generating circuit 60 includes the following elements: electric power recovering circuit 61 for recovering and reusing the electric power for driving sustain electrodes SU1 to SUn; and clamping circuit 62 for clamping sustain electrodes SU1 to SUn to the voltage Vs and 0 (V). Sustain pulse generating circuit 60 is connected to sustain electrodes SU1 to SUn, i.e. one of the ends of interelectrode capacitance Cp of panel 10.

Electric power recovering circuit 61 includes electric power recovering capacitor C30, switching element Q31, switching element Q32, blocking diode D31, blocking diode D32, and resonance inductor L30. The electric power recovering circuit causes the sustain pulse to rise and fall by causing LC resonance between interelectrode capacitance Cp and inductor L30. Clamping circuit 62 includes switching element Q33 for clamping sustain electrodes SU1 to SUn to the voltage Vs, and switching element Q34 for clamping sustain electrodes SU1 to SUn to the base electric potential, 0 (V). Sustain electrodes SU1 to SUn are connected to electric power supply VS and clamped to the voltage Vs via switching element Q33. Sustain electrodes SU1 to SUn are grounded and clamped to 0 (V) via switching element Q34.

Scan electrode driving circuit 44 includes the following elements: electric power supply VE1 for generating the voltage Ve1, switching element Q36 and switching element Q37 for applying the voltage Ve1 to sustain electrodes SU1 to SUn; electric power supply ΔVE for generating a voltage ΔVe; blocking diode D33; charge pump capacitor C31 for adding the voltage ΔVe to the voltage Ve1; and switching element Q38 and switching element Q39 for providing the voltage Ve2 by adding the voltage ΔVe to the voltage Ve1.

For example, at the timing of application of the voltage Ve1 shown in FIG. 3, switching element Q36 and switching element Q37 are brought into conduction, and the positive voltage Ve1 is applied to sustain electrodes SU1 to SUn via diode D33, switching element Q36, and switching element Q37.

At this time, switching element Q38 is brought into conduction and capacitor C31 is charged at the voltage Ve1. At the timing of application of the voltage Ve2 as shown in FIG. 3, while switching element Q36 and switching element Q37 are kept in conduction, switching element Q38 is brought out of conduction and switching element Q39 into conduction. Thus, the voltage ΔVe is superimposed on the voltage of capacitor C31, and a voltage (Ve1+ΔVe), i.e. the voltage Ve2, is applied to sustain electrodes SU1 to SUn. At this time, blocking diode D33 works to block the current from capacitor C31 to electric power supply VE1.

The resonance period of LC resonance between inductor L1 of electric power recovering circuit 51 and interelectrode capacitance Cp of panel 10, and the resonance period of LC resonance between inductor L30 of electric power recovering circuit 61 and interelectrode capacitance Cp of the panel can be obtained with the formula "$2\pi\sqrt{(LCp)}$" where L represents the inductance of each of inductor L1 and inductor L30. In this exemplary embodiment, inductor L1 and inductor L30 are set so that the resonance period in electric power recovering circuit 51 and electric power recovering circuit 61, respectively, is approximately 1,500 nsec. This value is a simple example and can be set optimum for the characteristics of the panel, the specifications of the plasma display device, or the like.

Figure 7:
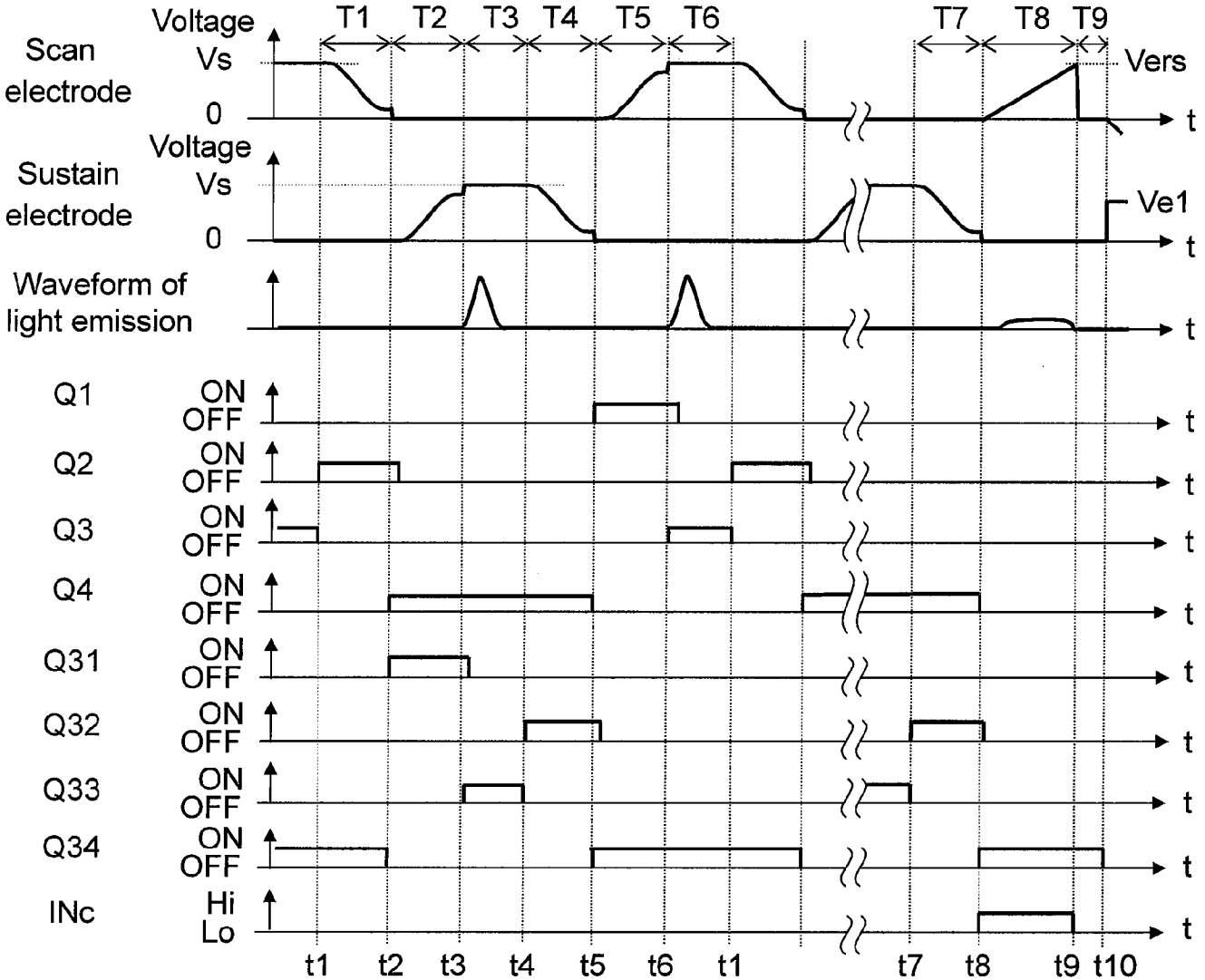
FIG. 7 is a timing diagram for explaining an example of the operation of the scan electrode driving circuit and the sustain electrode driving circuit in accordance with the exemplary embodiment of the present invention.

Next, a detailed description is provided of the driving voltage waveforms in the sustain periods. FIG. 7 is a timing diagram for explaining an example of the operation of scan electrode driving circuit 43 and sustain electrode driving circuit 44 in accordance with the exemplary embodiment of the present invention.

First, one periodic cycle of the sustain pulse is divided into six sub-periods of T1 to T6, and a description is provided of each sub-period. This periodic cycle refers to the interval of the sustain pulses to be repeatedly applied to each display electrode pair in the sustain periods, e.g. a repeated cycle composed of the sub-periods T1 to T6. In FIG. 7, positive waveforms are shown for explanation. However, the present invention is not limited to these waveforms. Although exemplary embodiments of negative waveforms are omitted, the same advantages can be offered for the negative waveforms. For the negative waveforms, "rising" and "falling" in the positive waveforms in the following descriptions are read as "falling" and "rising", respectively. In the diagram, the signal for turning on the switching elements is indicated as "ON", and the signal for turning off as "OFF".

(Sub-Period T1)

At time t1, switching element Q2 is turned on. Then, the electric charge on the side of scan electrodes SC1 to SCn begins to flow toward capacitor C1 through inductor L1, diode D2, and switching element Q2, and thus the voltage of scan electrodes SC1 to SCn begins to decrease. Because inductor L1 and interelectrode capacitance Cp forms a resonance circuit, at time t2 after a half the resonance period has elapsed, the voltage of scan electrodes SC1 to SCn is decreased to approximately 0 (V). However, the power loss due to the resistance components of the resonance circuit or the like hinders the voltage of scan electrodes SC1 to SCn from reaching 0 (V). During this period, switching element Q34 is kept ON.

(Sub-Period T2)

At the time t2, switching element Q4 is turned on. Then, scan electrodes SC1 to SCn are directly grounded via switching element Q4. Thus, the voltage of scan electrodes SC1 to SCn is forced to decrease to 0 (V).

Further, at the time t2, switching element Q31 is turned on. Then, current begins to flow from electric power recovering capacitor C30 through switching element Q31, diode D31, and inductor L30, and thus the voltage of sustain electrodes SU1 to SUn begins to increase. Because inductor L30 and interelectrode capacitance Cp forms a resonance circuit, at time t3 after a half the resonance period has elapsed, the voltage of sustain electrodes SU1 to SUn is increased to the vicinity of the voltage Vs. However, the power loss due to the resistance components of the resonance circuit or the like hinders the voltage of sustain electrodes SU1 to SUn from reaching the voltage Vs.

(Sub-Period T3)

At the time t3, switching element Q33 is turned on. Then, sustain electrodes SU1 to SUn are directly connected to the electric power supply VS via switching element Q33, and thus the voltage of sustain electrodes SU1 to SUn is forced to increase to the voltage Vs. At this time, in the discharge cells having generated address discharge, the voltage between scan electrode SCi and sustain electrode SUi exceeds the breakdown voltage and causes sustain discharge.

(Sub-Periods T4 to T6)

The sustain pulse applied to scan electrodes SC1 to SCn and the sustain pulse applied to sustain electrodes SU1 to SUn have an identical waveform. The operation in the sub-periods T4 to T6 is the same as the operation in the sub-periods T1 to T3 in which scan electrodes SC1 to SCn are exchanged for sustain electrodes SU1 to SUn. Thus, the descriptions of the operation in these sub-periods are omitted.

Switching element Q2 only needs to be turned off after the time t2 before time t5. Switching element Q31 only needs to be turned off after the time t3 before time t4. Switching element Q32 only needs to be turned off after the time t5 before time t2 in the next cycle. Switching element Q1 only needs to be turned off after time t6 before time t1 in the next cycle. In order to lower the output impedance of sustain pulse generating circuit 50 and sustain pulse generating circuit 60, preferably, switching element Q34 is turned off immediately before the time t2, and switching element Q3 is turned off immediately before the time t1. Preferably, switching element Q4 is turned off immediately before the time t5, and switching element Q33 is turned off immediately before the time t4.

In the sustain periods, the above operation in the sub-periods T1 to T6 is repeated according to the necessary numbers of pulses. In this manner, the sustain pulse voltage that changes from the base electric potential 0 (V) to the voltage Vs for causing sustain discharge is applied alternately to the electrodes of each display electrode pair 24 so that the discharge cells generate sustain discharge.

Next, a description is provided of the operation when the erasing ramp voltage is generated at the end of each sustain period.

(Sub-Period T7)

This sub-period is a falling period of the sustain pulse applied to sustain electrodes SU1 to SUn, and is identical with the sub-period T4. In other words, switching element Q33 is turned off immediately before time t7, and switching element Q32 is turned on at the time t7. With this operation, the electric charge on the side of sustain electrodes SU1 to SUn begins to flow toward capacitor C30 through inductor L30, diode D32, and switching element Q32, and thus the voltage of sustain electrodes SU1 to SUn begins to decrease. Until application of the erasing ramp voltage is started (at time t8), switching element Q4 is kept ON so that scan electrodes SC1 to SCn are kept at the base electric potential, 0 (V).

(Sub-Period T8)

At the time t8, switching element Q34 is turned on so that the voltage of sustain electrodes SU1 to SUn is forced to drop to 0 (V).

Further, switching element Q4 is turned off immediately before the time t8, and input terminal INc is brought into the "Hi" state at the time t8. Thus, constant current flows from resistor R12 toward capacitor C11, the source voltage of switching element Q15 increases in a ramp form, and the output voltage of scan electrode driving circuit 43 begins to increase in a ramp form having a gradient steeper than that of the increasing ramp voltage. In this manner, the erasing ramp voltage, i.e. the second ramp voltage increasing from the base electric potential 0 (V) toward the voltage Vers, is generated. While this erasing ramp voltage is increasing, the voltage difference between scan electrode SCi and sustain electrode SUi exceeds the breakdown voltage. At this time, in this exemplary embodiment, each value is set so that discharge occurs only between scan electrode SCi and sustain electrode SUi. For example, the sustain pulse voltage Vs is set to approximately 210 (V), the voltage Vers to approximately 213 (V), and the gradient of the erasing ramp voltage to approximately 10 V/μsec. With these settings, weak discharge can be generated between scan electrode SCi and sustain electrode SUi. The weak discharge can be continued while the erasing ramp voltage is increasing.

At this time, if an instantaneous strong discharge is caused by a rapid change in voltage, a large amount of charged particles generated by the strong discharge form large wall charges to alleviate the rapid voltage change, and thus excessively erase the wall voltages formed by the preceding sustain discharge. In a panel having a larger screen size, and higher definition and higher driving impedance, waveform distortion, such as ringing, is likely to occur in the drive waveforms generated by the driving circuits. Thus, for the drive waveform for generating erasing discharge using a narrow width pulse described above, waveform distortion can cause strong discharge.

However, in this exemplary embodiment, the erasing ramp voltage for gradually increasing the applied voltage continuously causes weak erasing discharge between scan electrode SCi and sustain electrode SUi. Thus, even in a panel having a larger screen size, and higher definition and higher driving impedance, the generation of the erasing discharge can be stabilized, and the wall voltages on scan electrode SCi and sustain electrode SUi can be adjusted to a state optimum for stable generation of the succeeding address discharge.

Though not shown in the diagram, data electrodes D1 to Dm are kept at 0 (V), and thus a positive wall voltage is formed on data electrodes D1 to Dm.

(Sub-Period T9)

When the driving voltage supplied from ramp voltage generating circuit 53 reaches the voltage Vers at time t9, switching element Q16 is turned on. Thus, the current to be fed into input terminal INc to operate second Miller integrating circuit 56 is extracted by switching element Q16, and the operation of second Miller integrating circuit 56 is stopped.

As described above, when the voltage applied to scan electrodes SC1 to SCn is kept after the voltage is reached to the voltage Vers, abnormal electric discharge that induces erroneous discharge in the succeeding address period can occur. However, in this exemplary embodiment, immediately after the voltage applied to scan electrodes SC1 to SCn has reached the voltage Vers, the voltage is dropped to the base electric potential, 0 (V). This structure allows the priming particles generated by the erasing discharge to converge immediately. Thus, compared to the structure in which the voltage applied to scan electrodes SC1 to SCn has reached the voltage Vers and the voltage is kept for a predetermined time period, this structure can stabilize the wall charges and generation of the initializing discharge to be caused thereafter, particularly the initializing discharge caused by the decreasing ramp voltage in the selective discharge operation. In other words, the occurrence of this abnormal electric discharge is prevented in the initializing operation.

Then, after time t10 in the initializing period of the succeeding subfield, the initializing operation in the succeeding subfield is started. For example, when the succeeding subfield is a selective initializing subfield, the selective initializing operation is started. In other words, the decreasing ramp voltage is applied to scan electrodes SC1 to SCn, and the voltage Ve1 is applied to the sustain electrodes.

Figure 8:
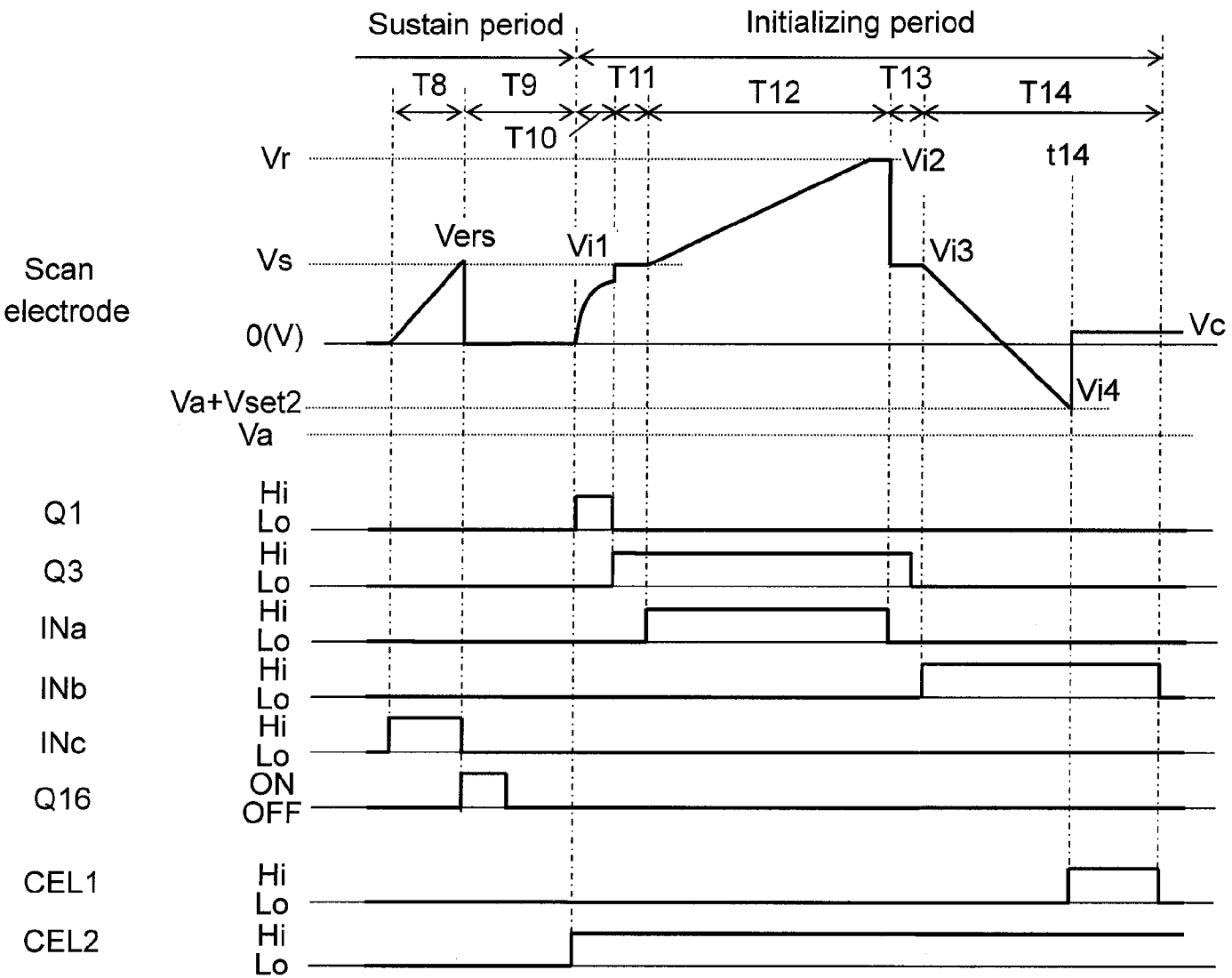
FIG. 8 is a timing diagram for explaining an example of the operation of the scan electrode driving circuit in an all-cell initializing period in accordance with the exemplary embodiment of the present invention.

Next, a detailed description is provided of the driving voltage in the initializing period. FIG. 8 is a timing diagram for explaining an example of the operation of scan electrode driving circuit 43 in an all-cell initializing period in accordance with the exemplary embodiment of the present invention. In this diagram, a drive waveform in the all-cell initializing operation is described as an example. The decreasing ramp voltage can be generated by the same control also in the selective initializing operation.

In FIG. 8, the driving voltage for causing the all-cell initializing operation is explained in each of five divided sub-periods, i.e. sub-periods T10 to T14. In the descriptions, the voltage Vi1 and the voltage Vi3 are equal to the voltage Vs, the voltage Vi2 is equal to a voltage Vr, and the voltage Vi4 is equal to the voltage (Va+Vset2), i.e. the resultant voltage of the negative voltage Va and the voltage Vset2 superimposed thereon. For the input signals CEL1 and CEL2 in the diagram, "1" is indicated as "Hi", and "0" as "Lo", in the similar manner.

For ease of understanding the difference between generation of the erasing ramp voltage and generation of the increasing ramp voltage, FIG. 8 also shows the operation in the sub-periods T8 and T9 in which the erasing ramp voltage is generated.

In order to make the voltage Vi4 equal to the voltage (Va+Vset2), i.e. the resultant voltage of the negative voltage Va and the voltage Vset2 superimposed thereon, the switching signal CEL2 is kept at "1" throughout the sub-periods T10 to T14. Though not shown in the diagram, switching element Q21 is kept OFF throughout the sub-periods T10 to T14. Though not shown, a signal having an opposite polarity to that of the signal to be fed into input terminal INa is fed into switching element Q12 forming the separator circuit. A signal having an opposite polarity to that of the signal to be fed into input terminal INb is fed into switching element Q13 forming the separator circuit.

(Sub-Period T8)

At the time t8, input terminal INc is brought into the "Hi" state. Thus, constant current flows from resistor R12 toward capacitor C11, the source voltage of switching element Q15 increases in a ramp form, and the output voltage of scan electrode driving circuit 43 begins to increase in a ramp form having a gradient steeper than that of the increasing ramp voltage.

(Sub-Period T9)

When the driving voltage supplied from ramp voltage generating circuit 53 reaches the voltage Vers, switching element Q16 is turned on. Then, the current to be fed into input terminal INc to operate second Miller integrating circuit 56 is extracted by switching element Q16, and the operation of second Miller integrating circuit 56 is stopped.

In this manner, the erasing ramp voltage, i.e. the second ramp voltage increasing from the base electric potential 0 (V) to the voltage Vers, is generated.

(Sub-Period T10)

Switching element Q1 in sustain pulse generating circuit 50 is turned on. Then, resonance is caused between interelectrode capacitance Cp and inductor L1, current flows from electric power recovering capacitor C1 through switching element Q1, diode D1, and inductor L1. Thus, the voltage of scan electrodes SC1 to SCn begins to increase.

(Sub-Period T11)

Switching element Q3 in sustain pulse generating circuit 50 is turned on. Then, the voltage Vs is applied to scan electrodes SC1 to SCn via switching element Q3 and switching element Q12. This operation makes the electric potential of scan electrodes SC1 to SCn equal to the voltage Vs (equal to the voltage Vi1, in this exemplary embodiment).

(Sub-Period T12)

Input terminal INa of the Miller integrating circuit for generating the increasing ramp voltage is brought into the "Hi" state. Specifically, a predetermined constant current is fed into input terminal INa. Then, constant current flows from resistor R10 toward capacitor C10, and thus the source voltage of switching element Q11 increases in a ramp form and the output voltage of scan electrode driving circuit 43 begins to increase in a ramp form. This voltage increase continues while input terminal INa is in the "Hi" state.

After this output voltage has increased to the voltage Vr (equal to the voltage Vi2, in this exemplary embodiment), input terminal INa is brought into the "Lo" state. Specifically, 0 (V), for example, is applied to input terminal INa.

In this manner, the increasing ramp voltage that gently increases from the voltage Vs (equal to the voltage Vi1, in this exemplary embodiment) of the breakdown voltage or lower toward the voltage Vr (equal to the voltage Vi2, in this exemplary embodiment) exceeding the breakdown voltage is applied to scan electrodes SC1 to SCn.

(Sub-Period T13)

Input terminal INa is brought into the "Lo" state. Then, the voltage of scan electrodes SC1 to SCn is decreased to the voltage Vs (equal to the voltage Vi3, in this exemplary embodiment). Thereafter, switching element Q3 is turned off.

(Sub-Period T14)

Input terminal INb of the Miller integrating circuit for generating the decreasing ramp voltage is brought into the "Hi" state. Specifically, a predetermined constant current is fed into input terminal INb. Then, constant current flows from resistor R11 toward capacitor C12, and thus the drain voltage of switching element Q14 decreases in a ramp form and the output voltage of scan electrode driving circuit 43 begins to decrease in a ramp form. Then, immediately before the initializing period is completed, input terminal INb is brought into the "Lo" state. Specifically, 0 (V), for example, is applied to input terminal INb.

In the sub-period T14, switching element Q13 is turned off. However, the Miller integrating circuit for generating the decreasing ramp voltage can decrease the output voltage of scan electrode driving circuit 43 via the body diode of switching element Q13.

In comparator CP, this decreasing ramp voltage is compared to the voltage (Va+Vset2), i.e. the resultant voltage of the voltage Va and the voltage Vset2 added thereto. The output signal from comparator CP changes from "0" to "1" at time t14 when the decreasing ramp voltage becomes equal to or lower than the voltage (Va+Vset2). The switching signal CEL2 is "1". Then, the signals to be fed into AND gate AG are both "1", and "1" is supplied from AND gate AG. Thus, scan pulse generating circuit 54 outputs the voltage Vc, i.e. the resultant voltage of the negative voltage Va and the voltage Vscn superimposed thereon. As a result, scan pulse generating circuit 54 outputs a decreasing ramp voltage in which the voltage Vi4 is equal to the voltage (Va+Vset2).

In this manner, scan electrode driving circuit 43 generates the increasing ramp voltage, i.e. the first ramp voltage gently increasing from the voltage Vi1 of the breakdown voltage or lower to the voltage Vi2 exceeding the breakdown voltage, and applies the ramp voltage to scan electrodes SC1 to SCn. Thereafter, the scan electrode driving circuit 43 generates the decreasing ramp voltage gently decreasing from the voltage Vi3 to the voltage Vi4 and applies the ramp voltage to scan electrodes SC1 to SCn.

Though not shown in the diagram, during the address period immediately after the completion of the initializing period, switching element Q21 is kept ON. This operation makes the voltage to be fed into one of the terminals of comparator CP equal to the negative voltage Va, thus keeping the output signal CEL1 from comparator CP at "1". Thereby, the output from AND gate AG is kept at "1". As a result, scan pulse generating circuit 54 outputs the voltage Vc, i.e. the resultant voltage of the negative voltage Va and the voltage Vscn superimposed thereon. At the timing of generating the negative scan pulse voltage, the switching signal CEL2 is changed to "0". This operation makes the output signal from AND gate AG "0", and scan pulse generating circuit 54 outputs the negative voltage Va. In this manner, the negative scan pulse voltage in the address period can be generated.

As described above, in this exemplary embodiment, at the end of each sustain period, that is, after the application of the sustain pulses to each display electrode pair, the erasing ramp voltage having a steeper gradient than the increasing ramp voltage is applied to scan electrodes SC1 to SCn to continuously cause weak erasing discharge. Further, immediately after the increasing voltage has reached the voltage Vers, the voltage is dropped to the base electric potential, 0 (V). This structure allows the priming particles generated by the erasing discharge to converge immediately, thus stabilizing the wall charges and the initializing discharge to be caused thereafter, particularly the initializing discharge to be caused by the decreasing ramp voltage in the selective initializing operation. Thus, even in a panel having a larger screen size and higher definition, this structure can stabilize generation of address discharge without increasing the voltage necessary for causing address discharge, and thus reduce the occurrence of operation failure in addressing. Further, in this exemplary embodiment, the second ramp voltage, i.e. the erasing ramp voltage, is generated so as to increase with a gradient gentler than that of the rising edge of the sustain pulse and steeper than that of the first ramp voltage, i.e. the increasing ramp voltage. Thus, the erasing discharge can be generated at a discharge intensity weaker than that of the sustain discharge and greater than that of the initializing discharge in the all-cell initializing operation. Therefore, when a subfield having a sustain period in which no sustain pulse but only the erasing ramp voltage is generated is provided in one field, the luminance weight of the subfield can be reduced to the half and a luminance weight smaller than 1. This structure can improve the gradation characteristics and thus smoothness of a display image. Therefore, the image display quality of plasma display device 1 can be improved.

Figure 9:
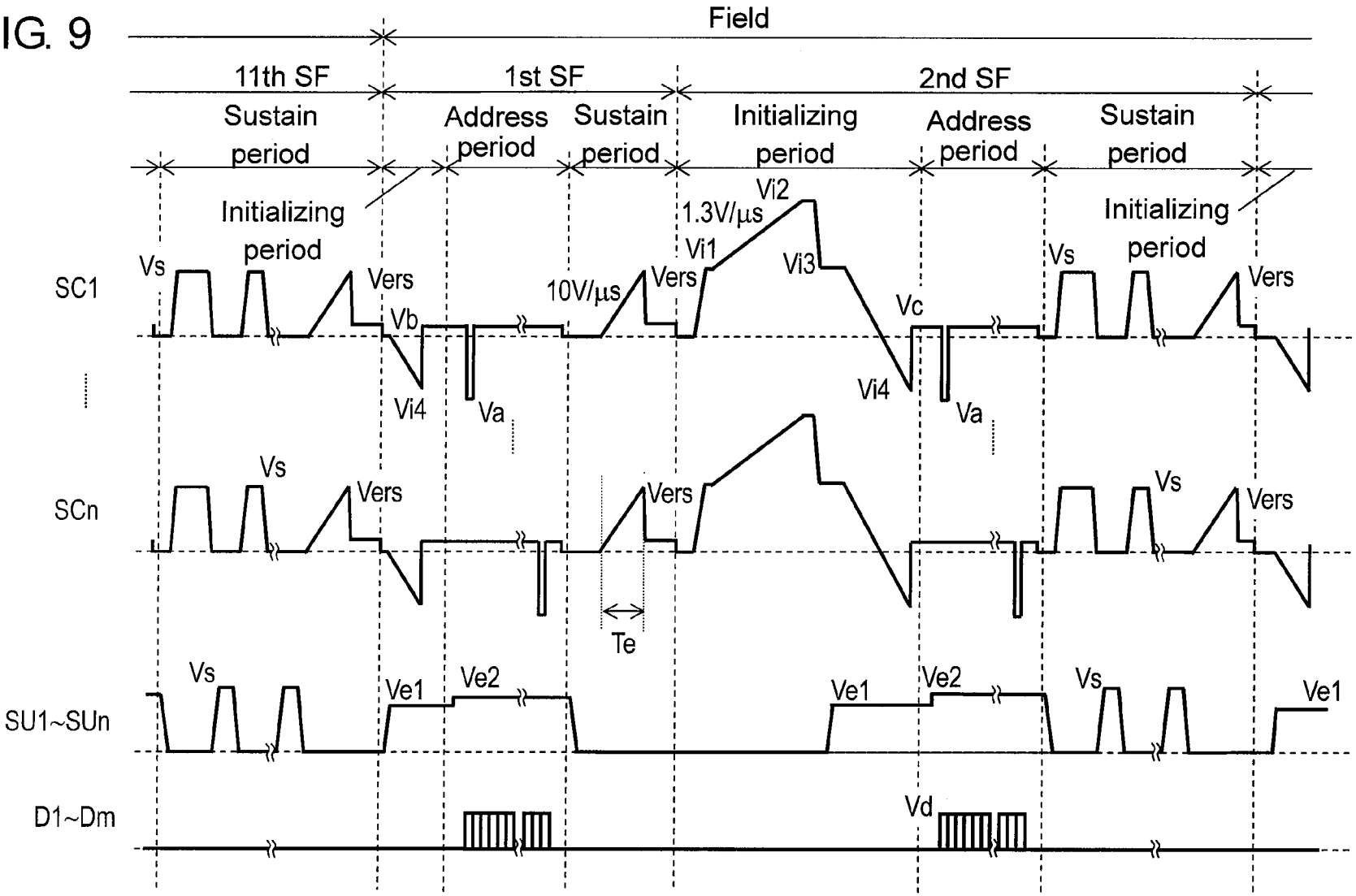
FIG. 9 is a chart showing another example of driving voltage waveforms in accordance with the exemplary embodiment of the present invention.

In this exemplary embodiment, the descriptions are provided for a structure of the erasing ramp voltage in which immediately after the increasing voltage has reached the voltage Vers, the voltage is dropped to the base electric potential, 0 (V). However, in order to prevent the above abnormal electric discharge, preferably, the electric potential to be reached at the drop of the erasing ramp voltage is set equal to or lower than 70% of the voltage Vers. FIG. 9 is a waveform chart showing another example of driving voltage waveforms in accordance with the exemplary embodiment of the present invention. For example, as shown in this chart, immediately after the erasing ramp voltage has reached the voltage Vers, the voltage is dropped to a voltage Vb (the voltage Vb being a voltage equal to or lower than the voltage Vers×0.7). This structure can offer the above advantage while preventing the above abnormal electric discharge, even when the voltage Vb is kept for a predetermined time period thereafter. In this exemplary embodiment, the lower voltage limit of the electric potential to be reached at the drop of the erasing ramp voltage is set to the base electric potential, 0 (V). The lower voltage limit is a value simply set so that the selective initializing operation at the succeeding decreasing ramp voltage can be performed smoothly. In this exemplary embodiment, this lower voltage limit is not limited to the above values, and can be set to any optimum value within the range in which the operation subsequent to the erasing operation can be performed smoothly.

In this exemplary embodiment, the descriptions are provided for a structure in which the first ramp voltage generating circuit for generating the increasing ramp voltage in the initializing operation is provided separately from the second ramp voltage generating circuit for generating the erasing ramp voltage. However, the present invention is not limited to this structure. In the present invention, both increasing ramp voltage and erasing ramp voltage are applied to scan electrodes SC1 to SCn. Thus, one ramp voltage generating circuit (e.g. a Miller integrating circuit) may be provided so that the gradient and the maximum value of the ramp voltage to be generated can be changed by a switching element or the like. In this structure, the first ramp voltage generating circuit and the second ramp voltage generating circuit can be formed of a common circuit.

In this exemplary embodiment, each of scan electrode driving circuit 43 of FIG. 5 and sustain electrode driving circuit 44 of FIG. 6 is a simple example of the structure, and any circuit structure may be used as long as the similar operation can be implemented. For example, the circuit for applying the voltage Ve1 and the voltage Ve2 is not limited to the circuit of FIG. 6. For example, a electric power supply for generating the voltage Ve1, a electric power supply for generating the voltage Ve2, and a plurality of switching elements for applying each voltage to sustain electrodes SU1 to SUn can be used to apply each voltage to sustain electrodes SU1 to SUn at a necessary timing. The circuit for generating the erasing ramp voltage shown in FIG. 5 is also a simple example of the structure. The circuit can be replaced with another circuit capable of implementing the similar operation.

This exemplary embodiment can also be applied to a panel driving method by so-called two-phase driving. An example of the two-phase driving method is as follows. First, scan electrodes SC1 to SCn are divided into a first scan electrode group and a second scan electrode group. The address period includes the following sub-periods: a first address sub-period in which a scan pulse is sequentially applied to the respective scan electrodes belonging to the first scan electrode group; and a second address sub-period in which a scan pulse is sequentially applied to the respective scan electrodes belonging to the second scan electrode group. In at least one of the first address sub-period and the second address sub-period, a scan pulse that changes from a second voltage higher than a scan pulse voltage to the scan pulse voltage and returns to the second voltage is sequentially applied to the scan electrodes belonging to the scan electrode group subjected to the scan pulse. Applied to the scan electrodes belonging to the scan electrode group subjected to no scan pulse is one of a third voltage higher than the scan pulse voltage, and a fourth voltage higher than the second voltage and the third voltage. While a scan pulse voltage is applied to at least adjacent scan electrodes, the scan pulse voltage is at the third voltage. Even in such a panel driving method, this exemplary embodiment can offer the same advantages as described above.

In the present invention, the erasing ramp voltage is applied to scan electrodes SC1 to SCn. In a conventional example, the last sustain pulse is applied to scan electrodes SC1 to SCn, and the erasing ramp voltage is applied to sustain electrodes SU1 to SUn. However, it is confirmed that an even number of sustain pulses generated in one sustain period can provide higher gradation and thus higher quality of a display image than an odd number of sustain pulses. When an even number of sustain pulses are generated in one sustain period, the sustain pulse generated at the end of the sustain period is applied to sustain electrodes SU1 to SUn. In other words, the present invention can offer a desirable advantage also in terms of image quality. Further, in the conventional example in which the erasing ramp voltage is applied to sustain electrodes SC1 to SCn, a waveform similar to that in the all-cell initializing operation of this exemplary embodiment, i.e. an initializing waveform including the increasing ramp voltage, needs to be applied to scan electrodes SC1 to SCn. In contrast, in the present invention, the erasing ramp voltage is applied to scan electrodes SC1 to SCn. Thus, the initializing operation in the selective initializing subfields can be performed by application of the above decreasing ramp voltage to scan electrodes SC1 to SCn. Therefore, the present invention can offer a desirable advantage also in terms of the time taken for the initializing operation.

In this exemplary embodiment, the descriptions are provided for a structure where one inductor is used in common to cause a sustain pulse to rise and fall in each of electric power recovering circuit 51 and electric power recovering circuit 61. However, a plurality of inductors may be used so that one inductor causes a sustain pulse to rise and the other inductor causes the sustain pulse to fall. In this case, different resonance periods may be set for the inductors as follows, for example. The inductor for the rising has a resonance period of approximately 1,200 nsec, and the inductor for the falling has a resonance period of approximately 1,500 nsec.

In this exemplary embodiment, the descriptions are provided for a structure where the first SF is a subfield in which only the erasing discharge is generated in the sustain period thereof so that the subfield has a half luminance weight, the second SF is an all-cell initializing subfield, and the first SF, and the third to eleventh SFs are selective initializing subfields. However, this subfield structure is a simple example of the exemplary embodiment. The present invention is not limited to this subfield structure. Preferably, the subfield structure is set optimum for the characteristics of the panel, specifications of the plasma display device, or the like.

In this exemplary embodiment, the descriptions are provided for a structure where one field includes one subfield in which no sustain pulse but only the second ramp voltage, i.e. the erasing ramp voltage, is generated in the sustain period thereof. However, the present invention is not limited to this structure. At least two such subfields may be provided in the one field.

The specific values in this exemplary embodiment, e.g. the value of the voltage Vers, and the gradient of the erasing pulse voltage, are set according to a 42-inch diagonal panel having 1,080 display electrode pairs used in the experiments, and simply represent an example of the exemplary embodiment. The present invention is not limited to these values. Preferably, values are set optimum for the characteristics of the panel, the specifications of the plasma display device, or the like. For each of these values, variations are allowed within the range in which the above advantages can be offered.

Industrial Applicability

In the present invention, immediately after an erasing ramp voltage, i.e. an increasing ramp voltage for erasing discharge, applied to scan electrodes at the end of each sustain period has reached a voltage Vers, the voltage is dropped. Even in a panel having a larger screen size and higher definition, this structure can stabilize the generation of address discharge without increasing the applied voltage necessary for causing the address discharge, and reduce the occurrence of operation failure in addressing. Further, the erasing discharge can be generated at a discharge intensity weaker than that of sustain discharge and greater than that of the initializing discharge in an all-cell initializing operation. Thus, the gradation characteristics of a display image can be improved by providing, in one field, at least one subfield having a sustain period in which no sustain pulse but only the second ramp voltage is generated. In other words, the present invention is useful as a plasma display device and a panel driving method that are capable of providing excellent image display quality.

The invention claimed is:

1. A plasma display device comprising:

a plasma display panel, the plasma display panel being driven by a subfield method for providing a plurality of subfields in one field to display gradation, each of the subfields including an initializing period, an address period, and a sustain period, the plasma display panel including a plurality of discharge cells, each of the discharge cells including a data electrode and a display electrode pair, the display electrode pair being made of a scan electrode and a sustain electrode;

a sustain pulse generating circuit that generates a sustain pulse for causing discharge at the number of times corresponding to a luminance weight in the sustain periods by causing resonance between interelectrode capacitance of the display electrode pairs and an inductor, and applies the sustain pulse alternately to the scan electrode and the sustain electrode of each of the display electrode pairs in the sustain periods; and a ramp voltage generating circuit, including:

a first ramp voltage generating circuit for generating, during the initializing periods, a gently increasing first ramp voltage;

a second ramp voltage generating circuit for generating, at the end of each of the sustain periods, a second ramp voltage increasing with a gradient gentler than a gradient of a rising edge of the sustain pulse and steeper than a gradient of the first ramp voltage; and a switching circuit for stopping operation of the second ramp voltage generating circuit immediately after the second ramp voltage has reached a predetermined electric potential, wherein, in at least one of the sustain periods in the one field, the data electrodes and the sustain electrodes are kept at 0(V), the sustain pulse generating circuit does not generate any sustain pulses, and the ramp voltage generating circuit generates the second ramp voltage, and wherein the second ramp voltage is applied only to the scan electrode and is not applied to the sustain electrode for each of the display electrode pairs.

2. The plasma display device of claim 1, wherein the ramp voltage generating circuit:

generates the first ramp voltage in the initializing period of at least one of the subfields in the one field; and applies the first ramp voltage to the scan electrode.

3. A plasma display panel driving method, the plasma display panel including a plurality of discharge cells, each of the discharge cells including a data electrode and a display electrode pair, the display electrode pair being made of a scan electrode and a sustain electrode, wherein the plasma display panel is driven by a subfield method for providing a plurality of subfields in one field to display gradation, each of the subfields includes an initializing period, an address period, and a sustain period, a sustain pulse for causing discharge at the number of times corresponding to a luminance weight in the discharge cells in the sustain periods is generated by resonance caused between interelectrode capacitance of the display electrode pairs and an inductor, and the sustain pulse is applied alternately to the scan electrodes and the sustain electrodes of the display electrode pairs in the sustain periods, the plasma display panel driving method comprising:

in the initializing periods, generating a first ramp voltage gently increasing; and at the end of each of the sustain periods, generating a second ramp voltage that increases with a gradient gentler than a gradient of a rising edge of the sustain pulse and steeper than a gradient of the first ramp voltage and drops immediately after the increasing voltage has reached a predetermined electric potential; and in at least one of the sustain periods in the one field, keeping the data electrodes and the sustain electrodes at 0(V), generating no sustain pulses and generating the second ramp voltage, wherein the second ramp voltage is applied only to the scan electrode and is not applied to the sustain electrode for each of the display electrode pairs.

* * * * *